US007013521B2

(12) United States Patent
Grey

(10) Patent No.: US 7,013,521 B2
(45) Date of Patent: Mar. 21, 2006

(54) SURFACE CLEANING APPARATUS

(75) Inventor: Nicholas Gerald Grey, 7 Laxton Close, Crowle, Worcestershire (GB) WR7 4BH

(73) Assignee: Nicholas Gerald Grey, (GB)

( * ) Notice: Subject to any disclaimer, the term of this patent is extended or adjusted under 35 U.S.C. 154(b) by 20 days.

(21) Appl. No.: 10/816,193

(22) Filed: Apr. 2, 2004

(65) Prior Publication Data

US 2004/0255411 A1 Dec. 23, 2004

Related U.S. Application Data

(63) Continuation-in-part of application No. 10/697,570, filed on Oct. 31, 2003, and a continuation-in-part of application No. 10/700,674, filed on Nov. 5, 2003.

(30) Foreign Application Priority Data

| | | |
|---|---|---|
| Jul. 20, 2001 | (GB) | 0117722 |
| Nov. 17, 2001 | (GB) | 0127652 |
| Nov. 2, 2002 | (GB) | 0225618 |

(51) Int. Cl.
*A47L 11/24* (2006.01)

(52) U.S. Cl. ..... 15/42; 15/377

(58) Field of Classification Search ..... 15/41.1, 15/42, 43, 52.1, 144.1, 144.2, 344, 363, 364, 15/377, 383, 385, 410, 411; 16/110.1, 408, 16/409

See application file for complete search history.

(56) References Cited

U.S. PATENT DOCUMENTS

| | | | | |
|---|---|---|---|---|
| 2,235,432 A | | 3/1941 | Kenyon | |
| 3,184,775 A | | 5/1965 | Downey et al. | |
| 3,460,188 A | | 8/1969 | Boyd | |
| 3,906,585 A | * | 9/1975 | Mattsson | 15/349 |
| 3,978,539 A | | 9/1976 | Yonkers et al. | |
| 4,099,284 A | | 7/1978 | Shinozaki et al. | |
| 4,177,533 A | | 12/1979 | Liebscher et al. | |
| 4,369,539 A | | 1/1983 | Nordeen | |
| 4,457,042 A | | 7/1984 | Jones et al. | |
| 4,864,682 A | * | 9/1989 | Bewley et al. | 15/371 |
| 4,993,108 A | | 2/1991 | Genge et al. | |
| 5,101,534 A | * | 4/1992 | Watanabe et al. | 15/377 |
| 5,224,232 A | * | 7/1993 | Zahuranec et al. | 15/41.1 |
| 5,379,483 A | | 1/1995 | Pino | |
| 5,400,467 A | * | 3/1995 | Hwang | 15/364 |
| 5,617,611 A | | 4/1997 | Worwag | |
| 5,765,258 A | | 6/1998 | Melito et al. | |
| 5,896,611 A | | 4/1999 | Haaga | |

(Continued)

FOREIGN PATENT DOCUMENTS

DE 18 14 398 9/1970

(Continued)

OTHER PUBLICATIONS

International Search Report dated Aug. 25, 2004 for Application No. EP 04 01 1243.

(Continued)

*Primary Examiner*—Terrence R. Till
(74) *Attorney, Agent, or Firm*—Shook, Hardy & Bacon LLP

(57) ABSTRACT

A surface cleaning apparatus comprises a body including a rear compartment, a forward compartment and an intermediate compartment arranged between the rear and forward compartments. An elongate rotatable brush arrangement is positioned within and extends across the forward compartment. An electric motor is positioned in the rear compartment for driving the rotatable brush arrangement and the electric motor.

35 Claims, 16 Drawing Sheets

U.S. PATENT DOCUMENTS

| | | | | | |
|---|---|---|---|---|---|
| 5,901,402 | A | * | 5/1999 | Williams | 15/144.1 |
| 5,920,939 | A | | 7/1999 | Worwag | |
| 6,000,090 | A | * | 12/1999 | Sutherland | 15/230.11 |
| 6,189,179 | B1 | * | 2/2001 | Baird | 15/364 |

FOREIGN PATENT DOCUMENTS

| | | | | |
|---|---|---|---|---|
| DE | 7203819 | | | 7/1972 |
| DE | 2239135 | | | 2/1974 |
| DE | 1 533 494 | | | 7/1975 |
| DE | 30 05 238 | A1 | | 8/1981 |
| DE | 196 01 976 | | | 7/1997 |
| DE | 199 14 574 | | | 11/2000 |
| EP | 0 285 096 | | | 10/1988 |
| EP | 1 203 556 | A2 | | 5/2002 |
| EP | 1 319 758 | A2 | | 6/2003 |
| FR | 2051364 | | * | 4/1971 |
| FR | 2 228 459 | | | 12/1974 |
| FR | 2778079 | | | 11/1999 |
| GB | 1 442 587 | | | 7/1976 |
| GB | 1 547 286 | | | 6/1979 |
| GB | 2 137 486 | | | 10/1984 |
| GB | 2 318 279 | | | 4/1998 |
| GB | 2351435 | A | | 1/2001 |
| JP | 49-55164 | | | 5/1974 |
| JP | 52-43378 | | | 9/1975 |
| JP | 55-96126 | | | 7/1980 |
| JP | 108856/81 | | | 8/1981 |
| JP | 58-35176 | | * | 8/1983 |
| JP | 252122/88 | | | 10/1988 |
| JP | 4322625 | | | 11/1992 |
| JP | 10-201682 | | | 8/1998 |
| JP | 11-276392 | | | 10/1999 |
| JP | 1999-0078370 | | | 10/1999 |
| WO | WO 03/024292 | | | 3/2003 |

OTHER PUBLICATIONS

International Search Report dated Aug. 25, 2004 for Application No. EP 04 01 1244.

EP Search Report dated Apr. 5, 2005 for Application No. EP 04 02 9630.

* cited by examiner

SURFACE CLEANING APPARATUS

FIELD OF THE INVENTION

This invention relates to a surface cleaning apparatus, such as for a floor or upholstery, incorporating an elongate rotatable brush arrangement and an electric motor for rotating the brush.

BACKGROUND OF THE INVENTION

Current surface cleaning devices conventionally employ suction means. One of the drawbacks of such suction means is that the fans used to generate suction are relatively inefficient, i.e. typically 10 to 12 percent efficient in use, with the result that such apparatus tends not to be easily portable. This is especially the case where the apparatus incorporates batteries for powering the motor. It is therefore not practical to incorporate batteries of sufficient power in a readily portable suction cleaner in order to provide the degree of suction required for effective cleaning.

It is conventional to provide a surface cleaning apparatus, such as for sweeping, in which an elongate brush arrangement, sometimes known as a brush bar, is supported for rotation in a housing which is adapted to be propelled at least in a forwards direction. The brush arrangement generally extends transversely of the housing and is adapted to contact a surface beneath it. The brush arrangement is arranged to be rotated by friction resulting from propelling the housing across a floor. The housing can be provided with wheels which contact the surface. One of the drawbacks of such a construction is that the friction drive is not very effective.

It is also conventional to provide one or more auxiliary brush arrangements extending outwardly from one or two front corners of the housing. The auxiliary brush arrangement is provided for rotation about an axis inclined to the vertical and is provided with radial bristles. An auxiliary brush arrangement of this kind is described in GB-A-1 547 286. The auxiliary brush arrangement is freely rotatable and relies for its rotation on contact with the floor or a skirting board of a room during propulsion of the apparatus across the floor. Such means of rotation is unreliable and results in particles of dust and/or dirt on the floor being flicked towards the elongate rotating brush assembly for collection by the apparatus. Furthermore, contact of the circular auxiliary brush arrangement with the floor or a skirting board results in bristles of the auxiliary brush arrangement which extend outwardly sideways from the housing undergoing angular rotation effectively in a backwards direction. This means that an auxiliary brush means extending outwardly from a front right hand corner of the housing, as viewed from above and behind the apparatus, would be rotated in a clockwise direction and would flick dust and or dirt around behind it in the direction of the elongate rotating brush arrangement. This is not very satisfactory.

In current vacuum cleaner attachments, it is conventional to employ a flexible cleaning strip intended for cleaning hard floor surfaces, for example tiles, marble or linoleum. The flexible strip is intended to increase air speed and mechanically gather particles to assist performance. On a forward stroke the flexible strip will push particles forward. When the vacuum cleaner attachment is pulled in a rearward direction, the gathered particles are left behind by the strip and are extracted by the suction. A disadvantage is that the flexible strip can gather particles on the rearward side, away from the suction, when the attachment is pulled in a rearward direction. However, the action of the suction itself causes the majority of the particles on the rearward side of the flexible strip to pass under the flexible strip and be removed.

Conventional flexible cleaning strips used to clean hard floor surfaces can wear out relatively quickly due to the constant contact with the hard floor surface when in use. Flexible strips used on devices, for example, for washing hard floor surfaces are known to wear out relatively quickly without the benefit of a lubricating cleaning solution which reduces friction between the flexible strip and the floor.

SUMMARY OF THE INVENTION

It is therefore an object of the present invention to provide a surface cleaning apparatus which overcomes, or at least ameliorates, at least some of the problems of known apparatus.

In an embodiment, the invention provides a surface cleaning apparatus, comprising a body having a forward compartment and rear compartment; an elongate rotatable brush extending across the forward compartment; an electric motor in the rear compartment; a belt connecting the motor and rotatable brush; and a handle movable between an upright position and steering positions by rotation about an axis transverse to the axial direction of the handle, said handle being further rotatable around a second axis in said steering positions, wherein said second axis of rotation is offset from the axial direction of the handle.

In another embodiment, the invention comprises a surface cleaning apparatus, comprising a body having a forward compartment and rear compartment; an elongate rotatable brush extending across the forward compartment; an electric motor in the rear compartment; a belt connecting the motor and rotatable brush; and an intermediate compartment comprising a removable tray, wherein at least one side of the removable tray forms a wall of said body.

In other embodiments, the invention further comprises an auxiliary brush extending from the forward compartment. The auxiliary brush can be driven by the electric motor used to drive the elongate rotatable brush, such as by connecting the auxiliary brush to the elongate rotatable brush with a gear drive. In still other embodiments, the invention can comprise a body with a removable side wall to allow access to the intermediate compartment. The removable side wall can also include a cover. Alternatively, the entire intermediate compartment can be a removable tray. The walls of the removable tray can form one or more walls of the body of the apparatus. In an embodiment, the belt connecting the motor to the elongate rotatable brush passes through the intermediate compartment, preferably on the side of the compartment remote from a removable side wall.

In yet other embodiments, the wall between the forward and intermediate compartments can be inclined rearwardly, such as at an angle of about 15° to about 20°. The forward compartment can also have a movable portion to expose the bristles of the elongate rotatable brush. The wall between the rear and intermediate compartments can seal the rear compartment off from the intermediate compartment. The rear compartment can also be provided with ground-engaging wheels.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION OF THE INVENTION

Figure 1:
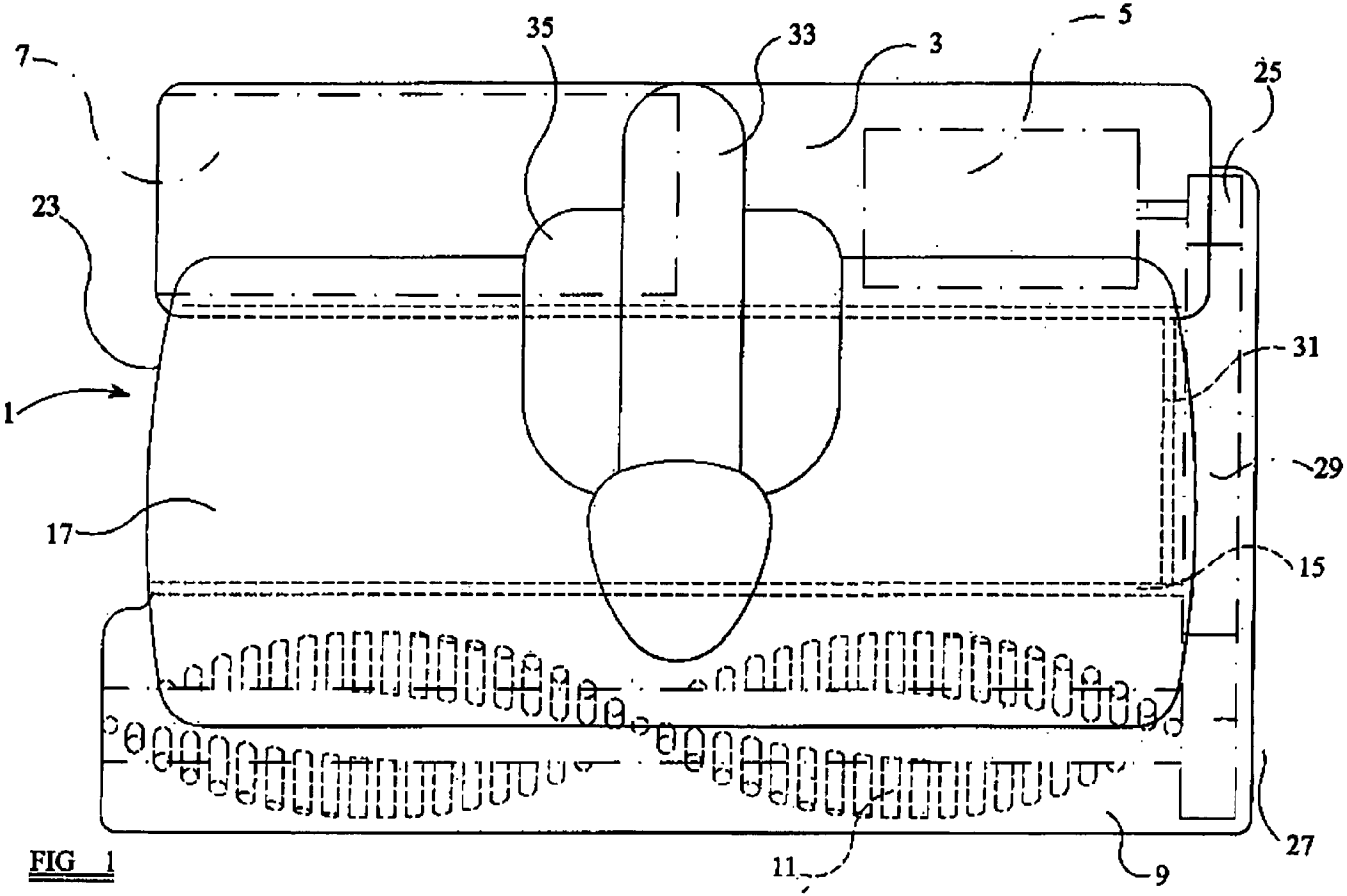
FIG. 1 is a plan view of one embodiment of a surface cleaning apparatus according to the present invention.
Figure 2:
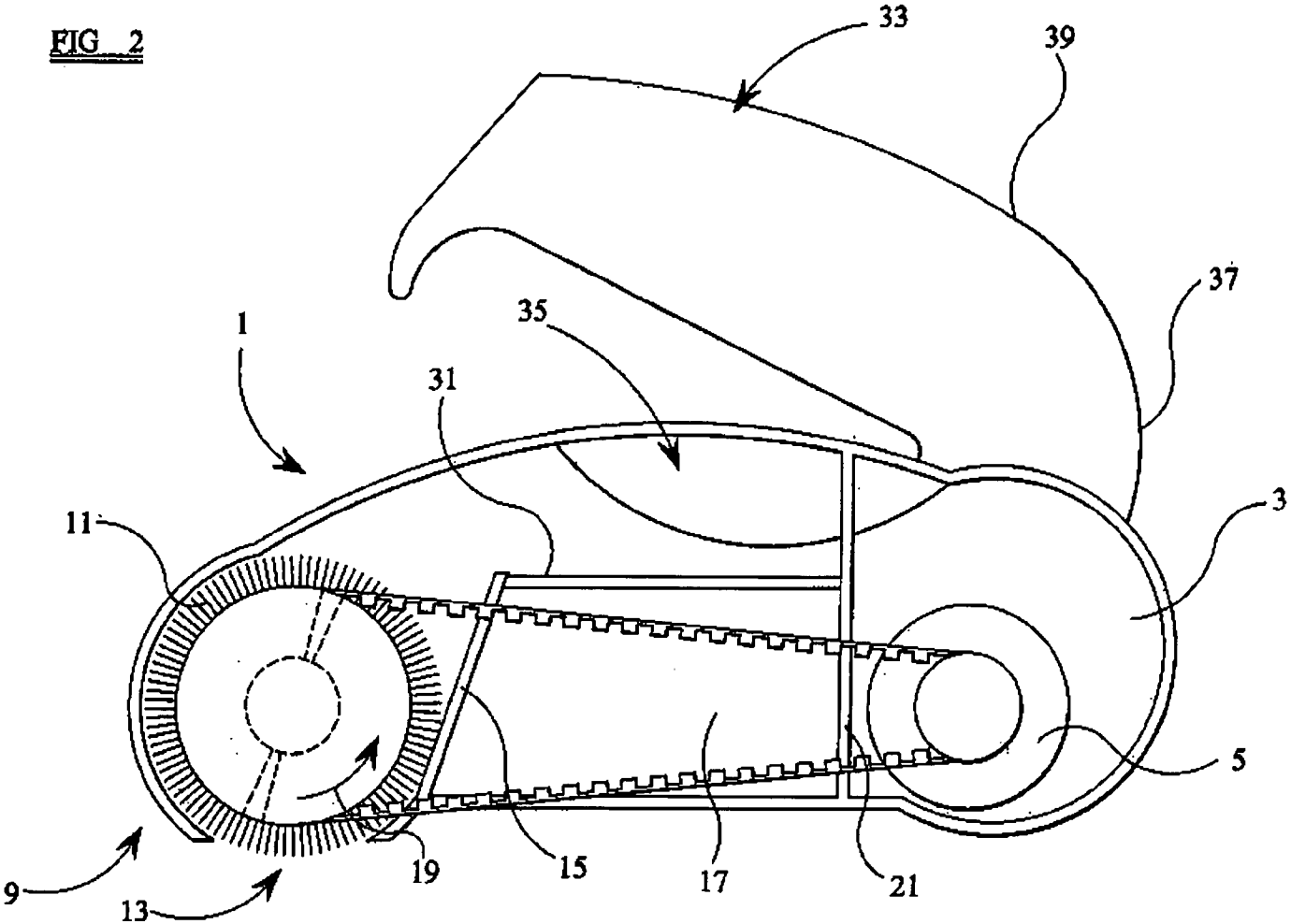
FIG. 2 is a side elevational view, partly in section, of the surface cleaning apparatus shown in FIG. 1.

The surface cleaning apparatus shown in FIGS. 1 and 2 comprises a body 1, suitably moulded of one or more plastic materials, and having effectively three compartments.

A rear compartment 3 houses an electric motor 5 and a rechargeable battery pack 7. The battery pack 7 may be connected to a main power supply (not shown) for recharging the battery pack. The battery pack may either be connected to the main supply whenever the apparatus is not in use or at suitable times when the battery pack has become depleted. Switch means (not shown) is provided to permit a user to energise and de-energise the motor 5 as desired. As an alternative to a rechargeable battery pack, the apparatus could employ disposable batteries or be main powered (i.e., adapted to use standard household alternating current).

A forward compartment 9 houses an elongate rotatable brush arrangement 11. For convenience a forward wall of the forward compartment is arcuate and extends around the periphery of the brush arrangement 11. The bottom of the forward compartment is open at 13 to allow the bristles of the brush arrangement to contact a floor, carpet or the like over which the surface cleaning apparatus is to be moved. The rear of the forward compartment is a rearwardly inclined wall 15 which allows debris, such as dust, dirt and the like, to be propelled up the wall due to rotation of the brush arrangement 11 and to pass over the wall into an intermediate compartment 17 which will be described in more detail hereinafter. The wall 15 extends upwardly to about the same height as the top of the brush arrangement 11 and is angled rearwardly (i.e. away from the forward compartment) at an angle of about 18 degrees. The precise angle is not important, but the inclination facilitates the passage of the debris up and over the wall and at the same time facilitates retention of the debris within the intermediate compartment 17. The brush arrangement extends substantially the entire width of the forward compartment and is provided with two helically arranged rows of bristles. The two rows are diametrically opposed and each row is in the form of a pair of separate helices which twist in opposite directions and meet substantially midway between the ends of the brush arrangement.

The intermediate compartment 17 is positioned between the wall 15 and a wall 21 which encloses the electrical components 5, 7 in the rear compartment 3, the wall 21 protecting the components in the rear compartment from the ingress of debris. The intermediate compartment 17 also has a lower wall or bottom, an upper wall or top, and side walls formed by the outer wall of the body 1. Debris therefore accumulates within the intermediate compartment 17. The intermediate compartment is provided with a removable closure to facilitate the removal of debris. For example, one of the walls, such as a side wall, the upper wall or the lower wall, can be removed in order that the debris can be emptied from the intermediate compartment, the removed wall being replaced once the compartment has been emptied. Ideally, side wall 23 is removable for emptying purposes. The wall 15 provides the advantage that debris does not readily escape from the intermediate compartment 17 and, even if the body is inclined such that the forward compartment is below the intermediate compartment, the debris does not escape from the intermediate compartment.

Figure 9:
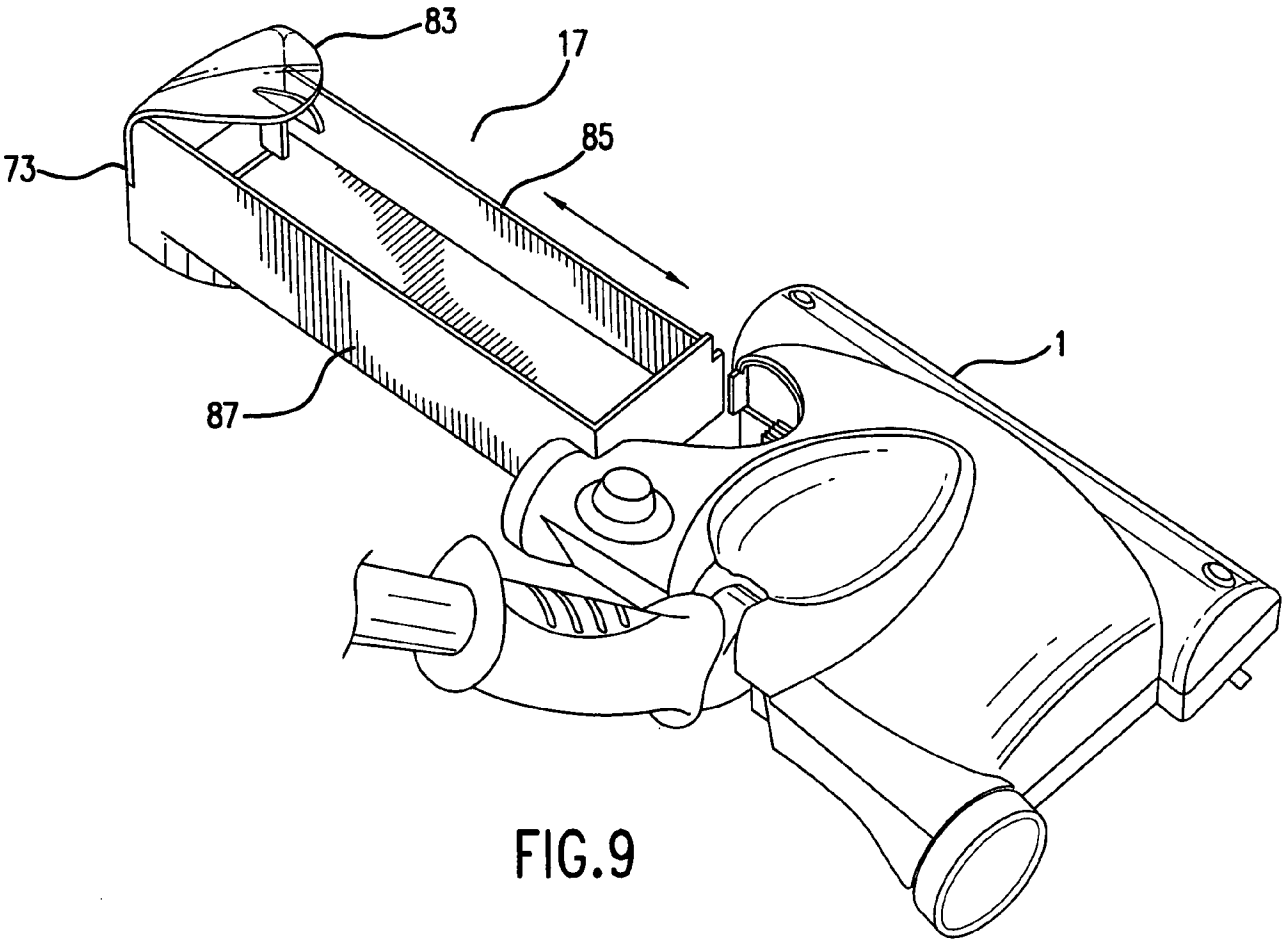
FIG. 9 depicts an embodiment of the surface cleaning apparatus with a removable tray.

In another embodiment, intermediate compartment 17 is a removable tray as shown in FIG. 9. In such an embodiment, side wall 23 can be separately removable from the intermediate compartment 17, or a side wall 73 and intermediate compartment 17 can be part of a single component as shown in FIG. 9. Intermediate compartment 17 can also incorporate additional structural portions of body 1, such as a portion 83 of the top wall of body 1. The top wall portion 83 and side wall 73 (or separately removable side wall 23) can be made of a transparent plastic material to allow for visual inspection of the amount of dirt collected in intermediate compartment 17. The bottom of removable tray 17 can serve as part of the bottom wall of body 1, or body 1 can have a separate bottom wall that tray 17 rests on when inserted into body 1.

In an embodiment, the removable tray serving as intermediate compartment 17 is separated from forward compartment 9 by at least one wall 85 formed by a side of intermediate compartment 17. A separate wall 15 (see FIG. 2) that is not attached to intermediate compartment 17 can also be present. Similarly, intermediate compartment 17 is separated from rear compartment 3 by a wall 87 that is integral to the intermediate compartment 17 and/or a separate wall 21.

Returning to FIGS. 1 and 2, in an embodiment the brush arrangement 11 is rotated by motor 5, such as by way of toothed rollers 25, 27 attached to the motor and to the brush, respectively, and by way of a toothed belt 29, for example of elastomeric material, extending around the two rollers. The toothed belt 29 is enclosed within a tunnel 31 where it passes through the intermediate compartment 17 in order to prevent the ingress of debris into the rear compartment 3. The tunnel 31 may pass through the intermediate compartment 17 at any convenient point. However, particularly in the event side wall 23 and/or intermediate compartment 17 is removable for emptying purposes, the tunnel may be arranged at that side of the intermediate compartment 17 remote from the side wall 23.

Figure 3:
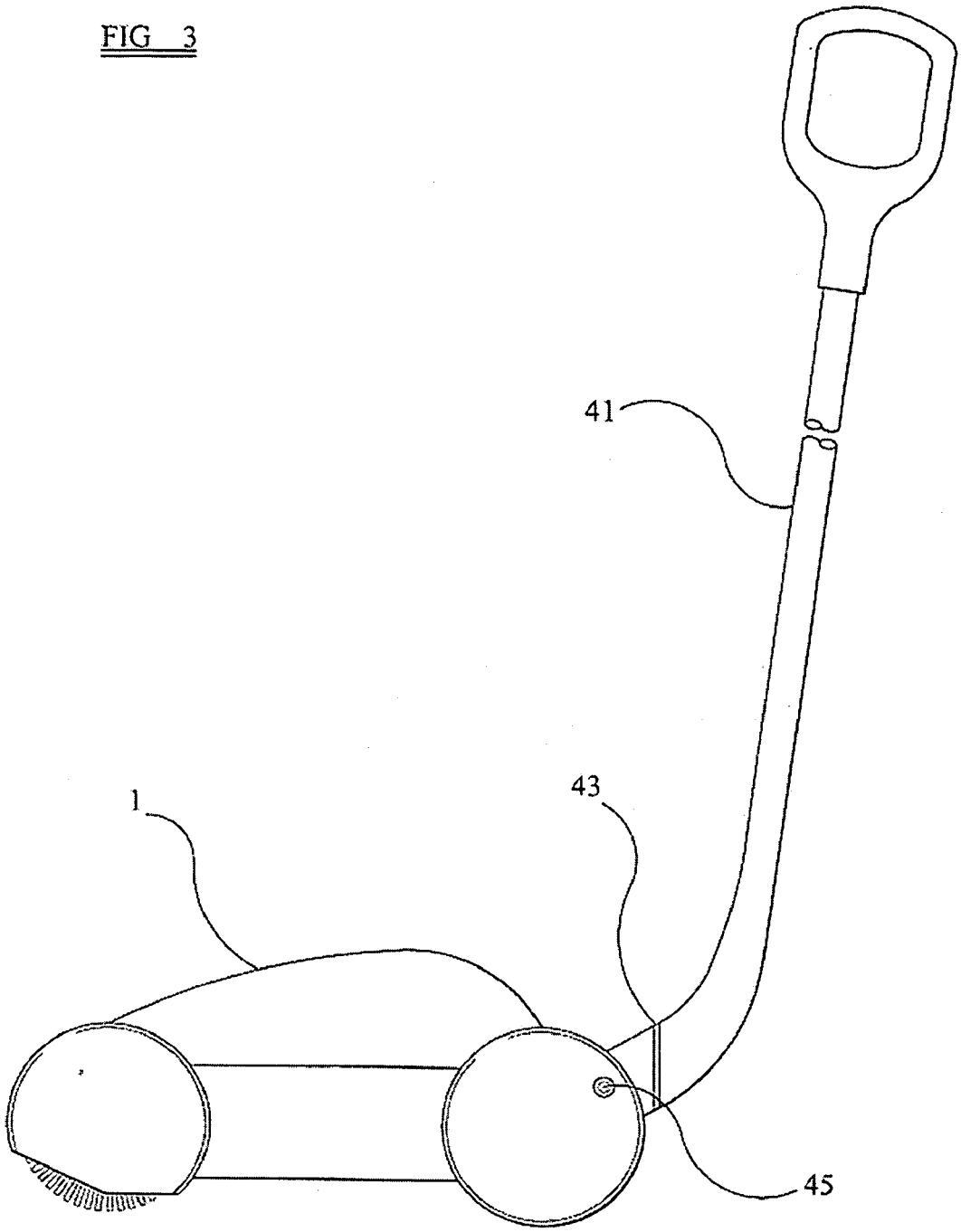
FIG. 3 is an elevational view of the surface cleaning apparatus of FIGS. 1 and 2 with an alternative handle.

A handle 33 is attached to the body 1 in the region of the rear compartment 3, the body being formed with a recess 35 beneath the handle to allow the handle to be gripped while maintaining a low profile for the surface cleaning apparatus. The handle 33 may be in two parts, a first part 37 which is secured to the body 1 and a second part 39 which can be removed from the first part and replaced by a longer handle part 41 as shown in FIG. 3. The longer handle part 41 is provided with swivel means 43 to allow the handle part 41 to rotate about the axis thereof relative to the body 1 and with pivot means 45 to allow the handle part to pivot about an axis transverse to the axial direction of the handle part to enable the surface cleaning apparatus to be steered by the user. As an alternative to interchangeable handles, the handle part 41 may be removably engageable with the handle part 33. In such a case, the handle part 33 is arranged such that the swivel means 43 functions only in certain positions of the handle part 33 in order that movement can be inhibited when the handle part 33 is used alone.

Figure 10:
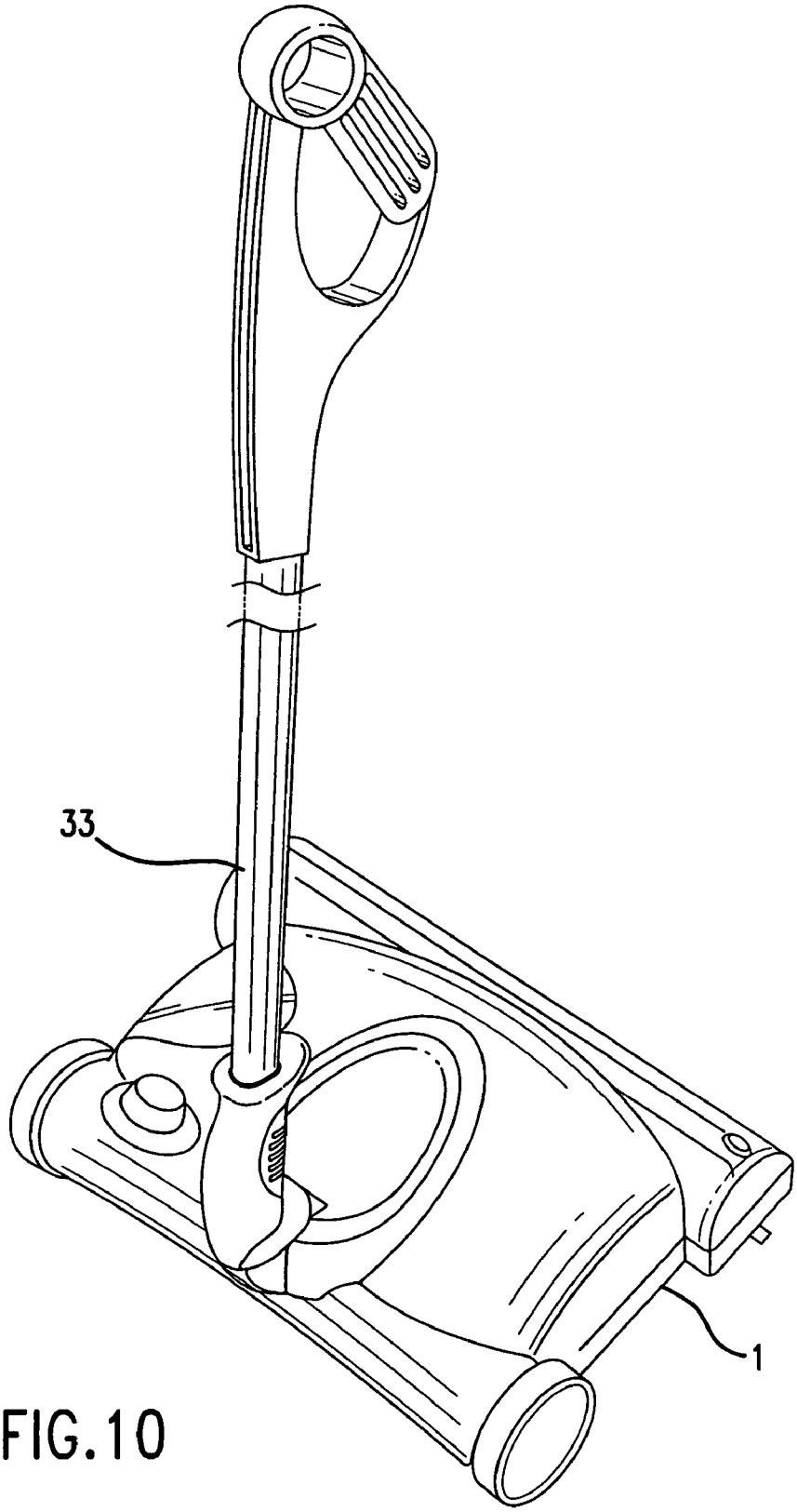
FIG. 10 is a perspective view of an embodiment of a surface cleaning apparatus with the handle in an upright position.
Figure 11:
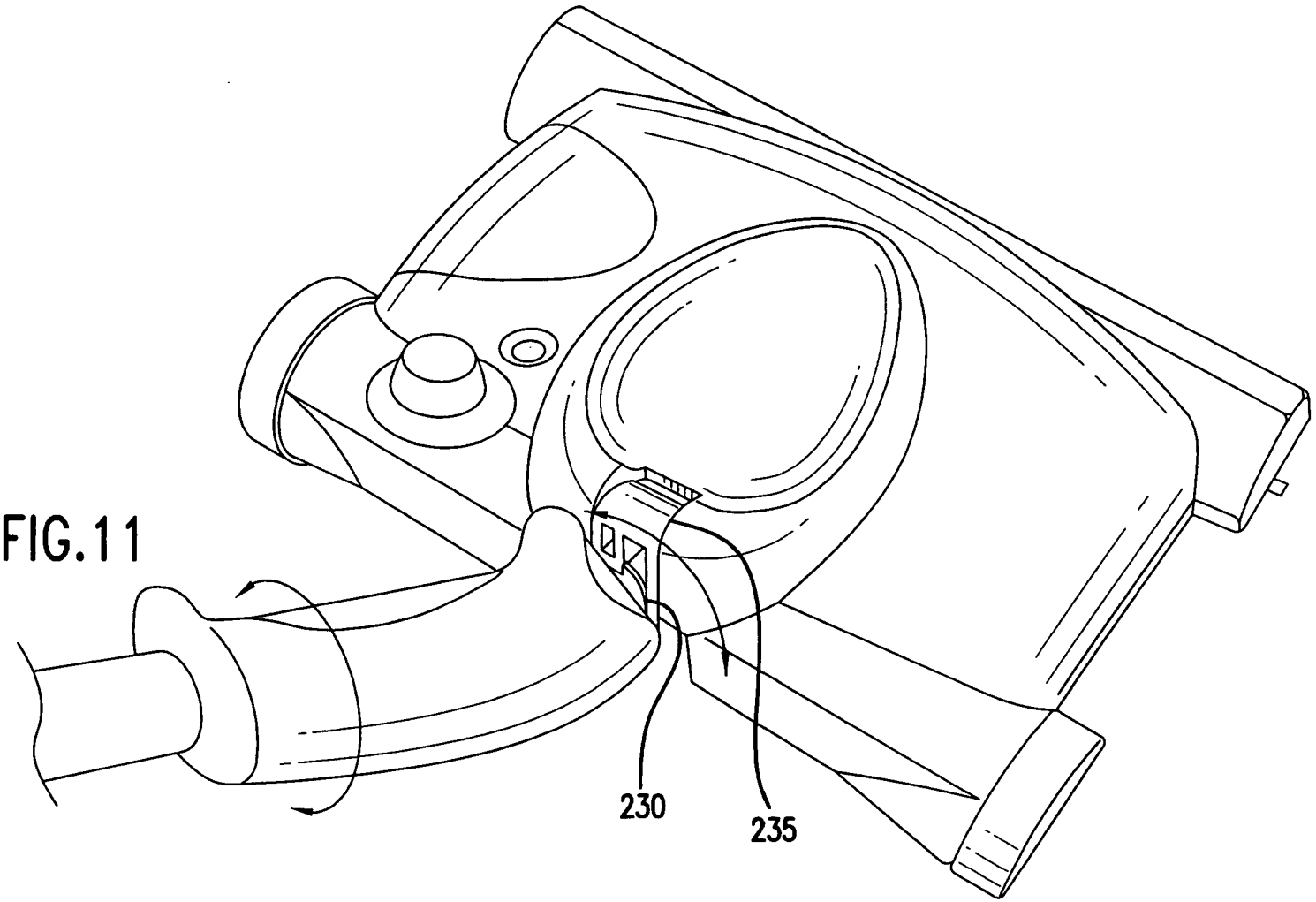
FIG. 11 is a perspective view of a surface cleaning apparatus with the handle in a lowered position.

FIGS. 10–12 depict another embodiment for connecting a handle 33 to body 1. FIG. 10 shows handle 33 in an upright position. From this upright position, handle 33 can be rotated around an axis transverse to the axial direction of the handle.

Rotating handle 33 around the axis transverse to the axial direction of the handle places the handle in a sweeping position, such as that shown in FIG. 11. Sweeping positions can be discrete positions along the axis of rotation, but preferably handle 33 will be able to smoothly rotate to any position along the arc of rotation. The term "sweeping position" will be used to refer to any position within this continuous arc other than upright positions.

Figure 12C:
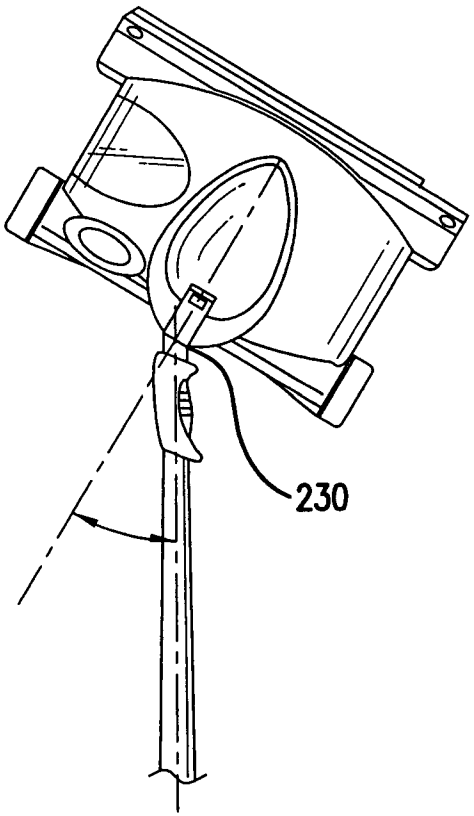
FIG. 12 depicts rotation of the handle in an embodiment of the surface cleaning apparatus.
Figure 12B:
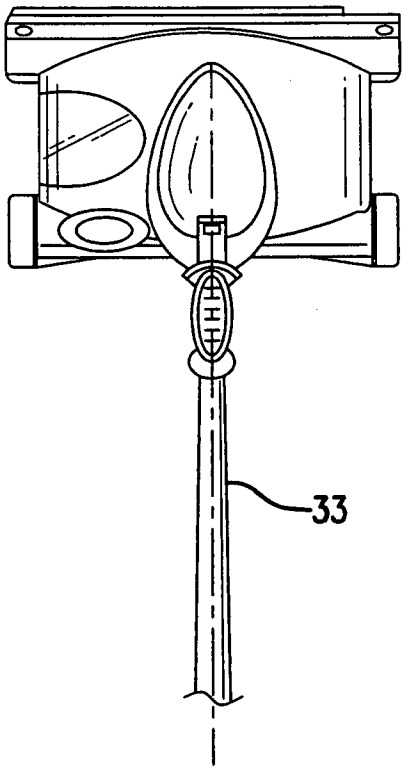
Figure 12A:
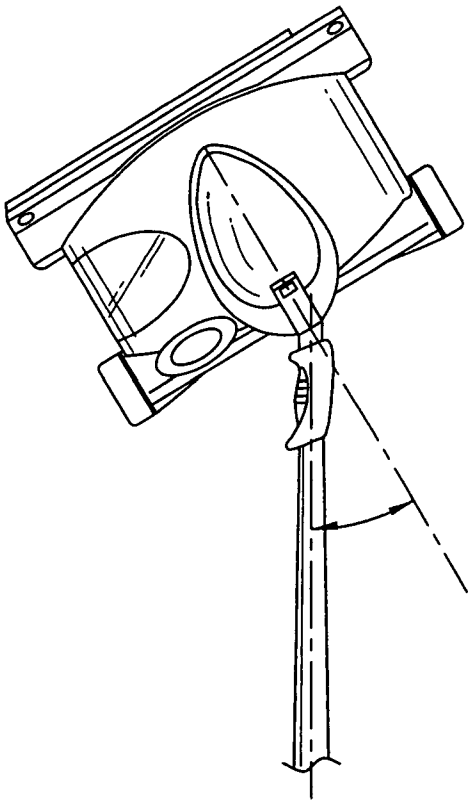

FIG. 11 shows a handle 33 pivotably attached to body 1 at attachment joint 230. In a sweeping position, handle 33 can be pivoted around attachment joint 230. In the embodiment shown in FIG. 11, the axial direction of handle 33 does not coincide with the pivot axis at attachment joint 230. As a result, handle 33 may be rotated around attachment joint 230, but the axis of rotation does not coincide with the axial direction of the handle. Instead, rotation around attachment joint 230 causes handle 33 to rotate into an offset position, as shown in FIGS. 12*a*–*c*. FIG. 12*a* shows a handle rotated to the left around attachment joint 230, while FIG. 12*c* shows a handle rotated to the right. Handle 33 is offset from its original axis in both FIGS. 12*a* and 12*c*.The offset created by rotating handle 33 around attachment joint 230 allows for ease of movement of the sweeper when attempting to move the sweeper around a corner or obstacle.

If handle 33 is returned to the upright position, handle 33 cannot rotate around attachment joint 230. Body 1 includes collar 235. When handle 33 is in the upright position, the attachment joint 230 is contained within collar 235 of body 1. In this position, attachment joint 230 cannot rotate, as collar 235 constrains the movement of handle 33. From the upright position, the only available direction of rotation for handle 33 is rotation between the upright and sweeping positions. When handle 33 is rotated down into a sweeping position, handle 33 can be rotated around attachment joint 230 by up to 90 degrees to either the right or left. However, in sweeping positions close to the upright position, rotation about attachment joint 230 may be constrained by collar 235.

FIGS. 12*a* and 12*c* depict rotation of handle 33 by 90 degrees around attachment joint 230. The resulting offset of handle 33 from its original axis can be expressed as an angular offset that corresponds to the plane angles indicated in FIGS. 12*a* and 12*c*.The amount of angular offset is determined by the axis of rotation for attachment joint 230 relative to the axial direction of the handle. In an embodiment, rotation of handle 33 by 90 degrees around attachment joint 230 results in an angular offset of 30 degrees relative to the original axis of handle 33.

As will be apparent particularly from FIG. 3, the bristles of the brush arrangement 11 extend outwardly from the aperture in the forward compartment 9. In order to remove stubborn debris and/or to revitalise carpet the lower front region of the forward compartment may be chamfered, or the front region of the forward compartment may be movable (including removable), to increase the exposure of the bristles in this region. In this way, the forward part of the apparatus may be inclined relative to the surface to be cleaned, thereby increasing contact between the bristles and a surface to be cleaned and, on some surfaces, increasing the depth to which the bristles penetrate and clean the surface.

Although not shown, an auxiliary rotary brush may be provided at that side of the brush arrangement 11 which incorporates the roller 27 and the belt 29. Such an auxiliary brush is described, for example, in GB-A-1 547 286. Such an auxiliary brush is able to sweep debris into the path of the brush arrangement 11 which might otherwise be missed due to the lack of bristles in the region of the roller 27. The auxiliary brush may be driven by any suitable means, such as gearing from the brush arrangement 11 or by friction with the surface to be swept, and is suspended from and extends outwardly beyond the body 1. The auxiliary brush may comprise a cylindrical body rotatable about an axis which is inclined to the vertical by about 10 degrees so as to extend outwardly beyond the body 1. Bristles protrude radially outwardly from the periphery of the cylindrical body, but need not be perpendicular to the axis of rotation and may preferably be at an angle of about 80 degrees to the axis of rotation so as to form a cone which increases in cross-section with increasing distance from the body 1.

Although not shown, the front part of the forward compartment 9 may be removed to expose the bristles at the front of the apparatus. This effectively increases the aperture in the forward compartment which would seriously impair the effectiveness of a suction cleaner, but in the present invention can effectively be used to assist in the sweeping of stairs, cleaning upholstery and carpets in vehicles and the like operations where a greater exposed area of bristles can be useful. As an alternative to removing the front part of the compartment 9, the front part may be movable, for example pivotable or slidable, relative to the remainder of the compartment in order to expose the bristles.

Although not shown, the rear compartment 3 may be provided with ground-engaging wheels in order to assist mobility of the surface cleaning apparatus. The ground-engaging wheels may, for example, be formed externally in the side regions of the rear compartment 3 or may be provided within recesses formed at least partly beneath the rear compartment 3.

Although the illustrated embodiments of the present invention are intended primarily for domestic use, the surface cleaning apparatus can also be used outdoors or in workshops if desired. However, it may be preferable to provide a more rugged design specifically adapted for such use.

In use of the surface cleaning apparatus according to the invention, as shown in FIGS. 1 and 2, the apparatus is placed upon a surface to be swept, such as a carpet, and the switch operated to energise the motor and consequently to rotate the brush arrangement to sweep debris from the surface and then propel the debris up and over the inclined wall 15 and into the intermediate compartment 17 where it is temporarily stored. As the surface cleaning apparatus is moved over the surface with the brush arrangement 11 rotating, any further debris is similarly swept from the surface and propelled up and over the wall 15 and into the intermediate compartment 17. The surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations.

When the intermediate compartment 17 is to be emptied, one wall of the compartment is removed as explained above and the debris can readily be discharged. The removable wall is then replaced. Alternatively, the intermediate compartment may be in the form of a tray which can be removed and emptied so as to discharge debris.

When the surface cleaning apparatus is not in use it can be stored, for example either in a cupboard or the like or plugged into a main supply in order to recharge the battery 7.

Thus the surface cleaning apparatus of the present invention incorporates an electrically driven brush arrangement. The brush arrangement is not driven by frictional forces between the surface cleaning apparatus and the surface over which it is to be moved. Thus, efficiency of the apparatus is not dependent on the nature of the frictional contact. Further, the apparatus does not rely on suction means to draw the debris into a storage chamber. Thus, efficiency of the apparatus is not dependent on the effectiveness of suction means and the substantial power drain of suction means on the rechargeable battery is avoided. The provision of the motor at the rear of the apparatus eliminates the need for increased height should the motor be positioned over the compartment for collecting dust and the like and also provides effective full width cleaning which would not be possible if the motor was to be positioned within the compartment for collecting debris. In such a position, debris is likely to accumulate around the motor and cause blockages. In an embodiment, the invention overcomes this problem by passing the drive means for the brush arrangement at least partly through the debris compartment.

Figure 4:
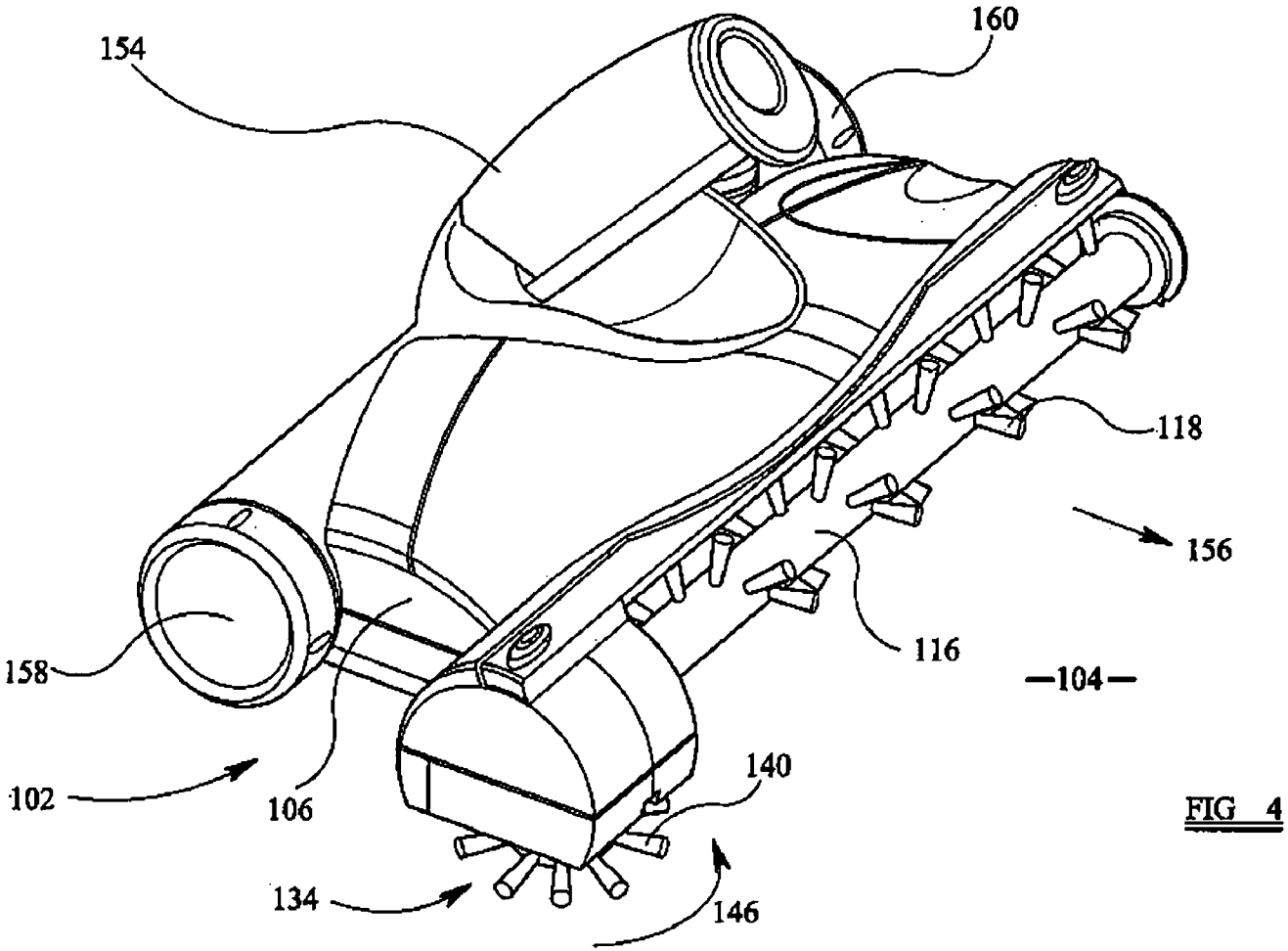
FIG. 4 is a perspective view of another embodiment of a surface cleaning apparatus according to the present invention with part of a brush bar cover removed for illustrative clarity.
Figure 5:
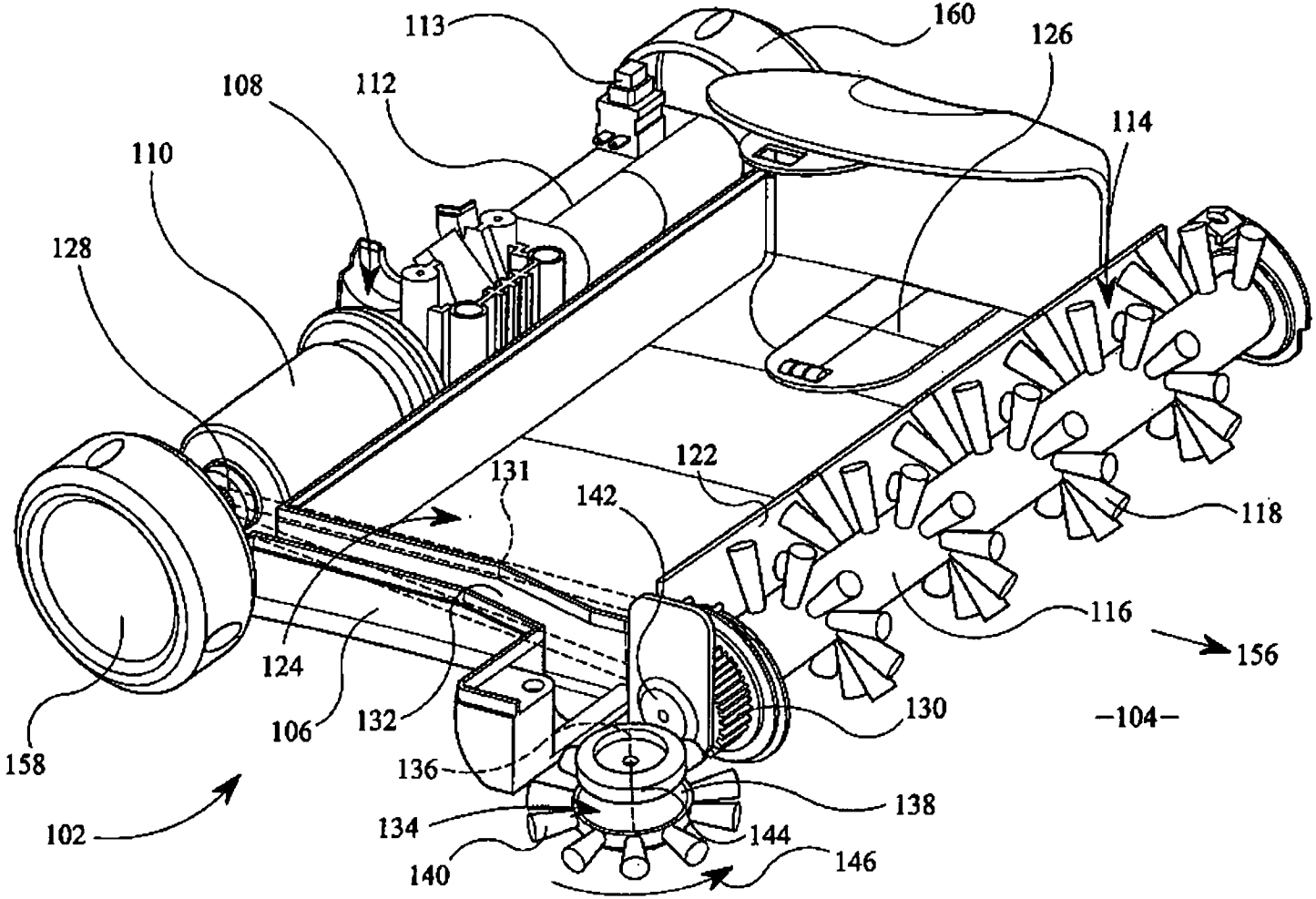
FIG. 5 is a perspective view of the apparatus of FIG. 4, with part of the housing thereof removed.
Figure 6:
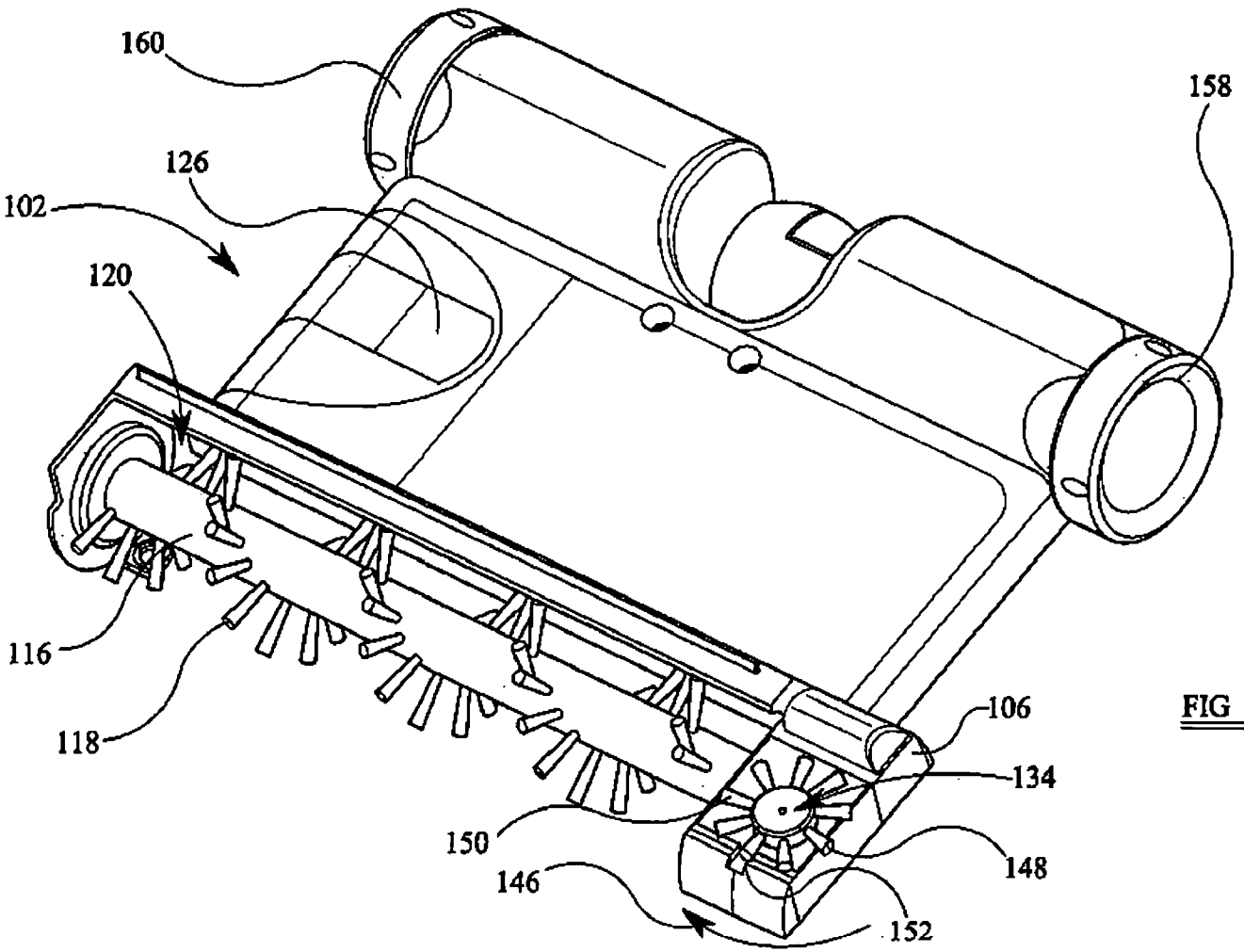
FIG. 6 is an underside view of the apparatus of FIG. 4 with part of the brush bar cover removed for clarity.

Referring to FIGS. 4, 5 and 6, apparatus 102 for cleaning a surface 104 by sweeping comprises a housing 106, suitably of moulded plastic materials, and effectively having three compartments. A rear compartment 108 houses an electric motor 110 and a rechargeable battery pack 112. The battery pack 112 may be connected to a main power supply (not shown) for recharging the battery pack. The battery pack may either be connected to the main supply whenever the apparatus is not in use or at suitable times when the battery pack has become depleted. Switch means 113 is provided to permit a user to energise and de-energise the motor 110 as desired. As an alternative to a rechargeable battery pack, the apparatus could employ disposable batteries or be main powered.

A forward compartment 114 houses a transversely-arranged elongate rotatable brush arrangement 116, with bristles 118. Such elongate rotatable brush arrangement 116 is sometimes known as a brush bar. The bottom of the forward compartment 114 is open at 120 to allow the bristles 118 of the elongate brush arrangement 116 to contact a floor, carpet or the like over which the apparatus is to be propelled. The rear of the forward compartment is a rearwardly inclined wall 122 which allows debris, such as dust, dirt and the like to be propelled up the wall due to rotation of the brush arrangement 116 and to pass over the wall into an intermediate compartment 124. The front of the forward compartment is provided with a cover (not shown) which may be removable if desired. Debris accumulating in the intermediate compartment 124 can be removed by opening a cover 126. The wall 122 extends upwardly to about the same height as the top of the elongate brush arrangement 116 and may be angled rearwardly (i.e. away from the forward compartment) such as at an angle of about 18 degrees. The precise angle is not important, but the inclination facilitates the passage of the debris up and over the wall 122 and at the same time facilitates retention of the debris within the intermediate compartment 124.

The elongate brush arrangement 116 is rotated by the motor 110 by way of toothed rollers 128, 130 attached to the motor and to the brush arrangement, respectively, and by way of a toothed belt 131, for example of elastomeric material, extending around the two rollers. The toothed belt 131 is enclosed within a tunnel 132 where it passes through or alongside the intermediate compartment 124 in order to prevent the ingress of debris into the rear compartment 108.

An auxiliary brush means 134 is provided extending outwardly from the housing 106 at the right hand side of the elongate rotatable brush arrangement 116 as viewed from above and behind the apparatus 102. The auxiliary brush means 134 is of substantially circular form and is supported for rotation about an axis 136, which may be vertical or inclined to vertical, such as at an angle of about 10 degrees to vertical. The auxiliary brush means 134 has a body 138 provided with radial bristles 140 which are inclined at an acute angle to the axis of rotation 136 so as to effectively form a conical arrangement increasing in cross-section with increasing distance from the body 138.

The auxiliary brush means 134 is rotatably driven from the rotating elongate brush arrangement 116 by a gear wheel 142 at the end of the elongate brush arrangement 116 which meshes with a further gear wheel 144 on the body 138 of the auxiliary brush means 134. The auxiliary brush means 134 is caused to be rotated in an anti-clockwise direction denoted by arrow 146, as viewed from above and behind the apparatus 102. During such rotation of the auxiliary brush means 134, a peripheral region thereof rotates from a sideways-directed position 148 (FIG. 6) outside the housing 106 to an opposed sideways-directed position 150 covered by the housing 106, through a forwardly-directed position 152.

The apparatus 102 is provided with a handle 154 by means of which it can be propelled at least in a forwards direction 156. Wheels 158 and 160 are provided to enable or assist manual propulsion of the apparatus across the surface 104 to be swept, such as a floor, stairway or upholstery. The handle 154 could be longer, or be of a different shape or form, as required.

The rotating auxiliary brush means 134 does not rely on contact with the surface 104 for its rotation and therefore provides more efficient sweeping of edge regions of the surface 104 regardless of the nature of the surface 104. Furthermore, the direction of rotation 146 of the auxiliary brush means 134 ensures that debris is swept positively by the auxiliary brush arrangement 134 into a position ahead of the rotating elongate rotating brush assembly 116, ready to be picked up by the elongate brush arrangement 116.

If desired, instead of or in addition to the auxiliary brush means 134 provided extending outwardly from the right hand side of the housing 106, a similar auxiliary brush means (not shown) could likewise be provided extending outwardly from the left hand side of the housing 106 and driven from the opposite end of the elongate brush arrangement 116. Such additional or alternative auxiliary brush means differs from the auxiliary brush means 134 only in that it is caused to rotate in a clockwise, rather than anti-clockwise, direction as viewed from above and behind the apparatus 102.

Instead of the apparatus 102 being provided with a battery or main powered electric motor 110 to drive the elongate brush arrangement 116 and hence the auxiliary brush means 134, a known form of friction drive means (not shown), resulting from propulsion of the apparatus 102 along the surface 104, may be utilised to effect rotation of the elongate brush arrangement 116 and hence rotation of the auxiliary brush means 134.

Figure 7:
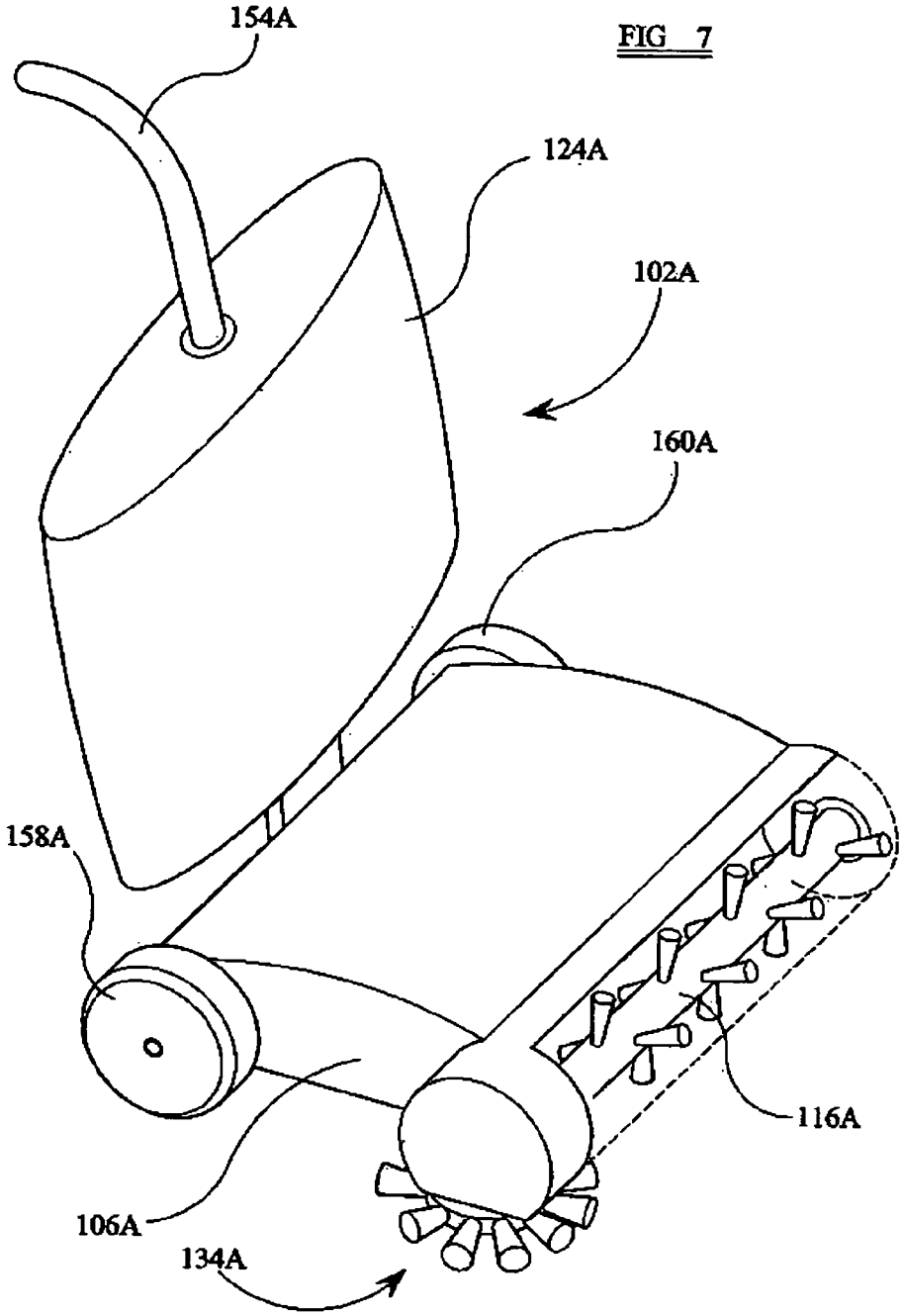
FIG. 7 is a perspective view of an alternative embodiment of surface cleaning apparatus according to the present invention with part of the brush bar cover removed for clarity (shown in dashed lines)

An alternative embodiment of apparatus according to the present invention is shown in FIG. 7. Such alternative embodiment comprises an upright vacuum cleaner apparatus 102A, having a housing 106A with wheels 158A and 160A, a rotating elongate brush arrangement 116A and an auxiliary brush means 134A. The apparatus 102A is constructed in substantially similar manner to the apparatus 102 of FIGS. 4, 5 and 6, with the main exception that instead of the debris-collecting compartment 124 of FIG. 5, a debris-collecting container 124A, which may include a bag, is provided between a handle 154A and the housing 106A and connected by a well-known form of suction arrangement (not shown) to the housing 106A.

Figure 8:
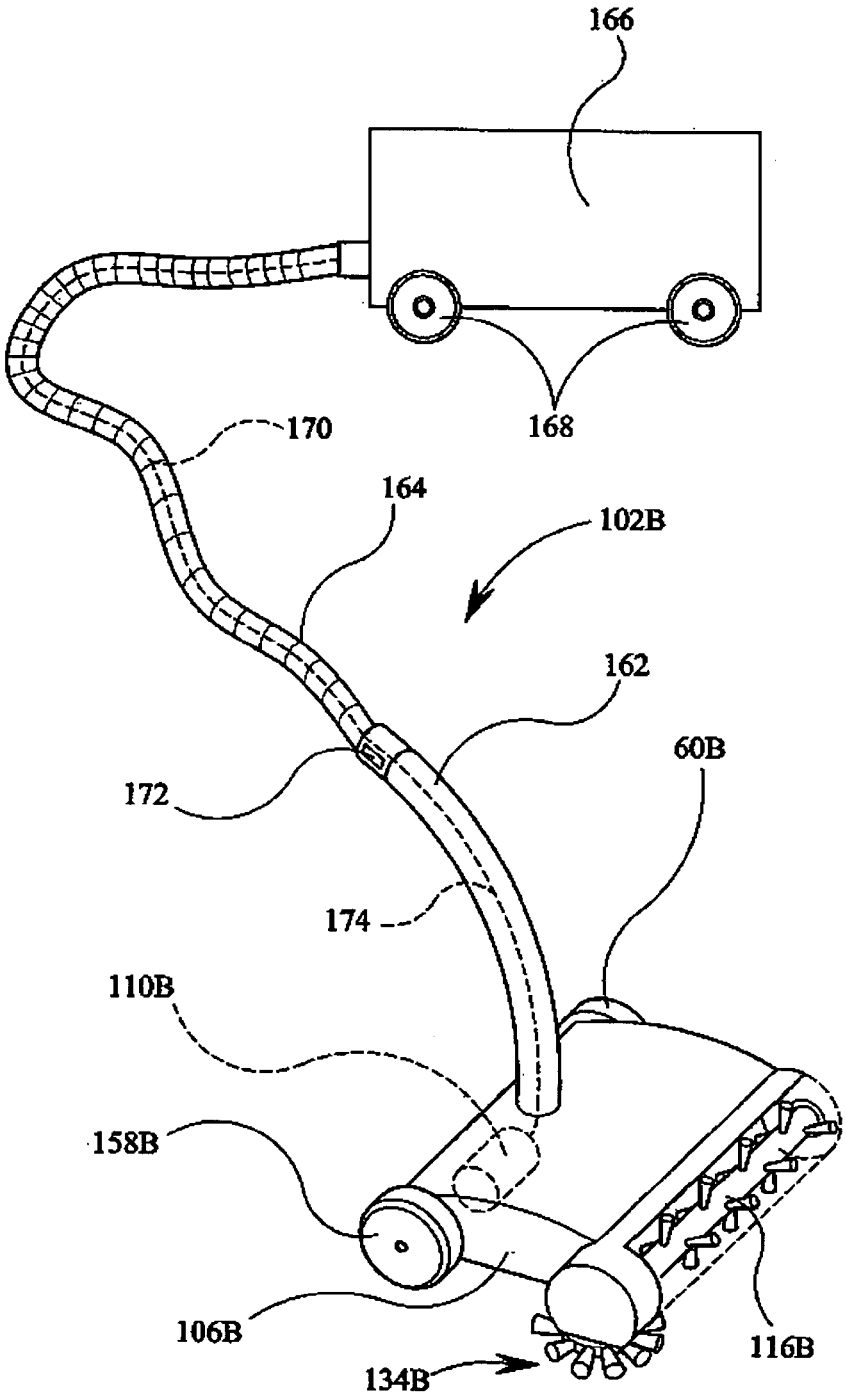
FIG. 8 is a perspective view of a further embodiment of a surface cleaning apparatus according to the present invention with part of the brush bar cover removed for clarity (shown in dashed lines)

A further embodiment of apparatus 102B according to the present invention is shown in FIG. 8. Here the housing 106B incorporates components similar to those of the housing 106 of FIGS. 4, 5 and 6 including wheels 158B and, in particular, an elongate rotating brush arrangement 116B with an auxiliary rotating brush means 134B driven therefrom. However, no debris-collecting compartment is provided inside the housing 106B. Instead, the housing 106B is provided with a tubular portion 162 which is demountable on, or may be fixed to, a debris-receiving flexible hose 164 connected to a well-known form of suction vacuum cleaner 166, which may be of cylinder form, mounted on wheels 168. Electrical wiring 170 can be incorporated in the hose 164 by means of which main electrical power can be supplied from the vacuum cleaner 166, and through a connector 172 and wiring 174 in the tubular portion 162, to an electric motor 110B where provided in the housing 106B for driving the elongate rotating brush arrangement 116B and the auxiliary brush means 134B. Of course, such wiring 170 would be unnecessary where the elongate brush arrangement 116B and the auxiliary brush means 134B driven therefrom, is caused to be rotated by the friction means previously described. Alternatively, the elongate brush arrangement 116B and the auxiliary brush means 134B may be caused to be rotated by means of a (rechargeable) battery or an air turbine driven by air passing along the tubular portion 162. The housing 106B with its included components could be provided as an accessory for existing vacuum cleaners of cylinder form.

Figure 13:
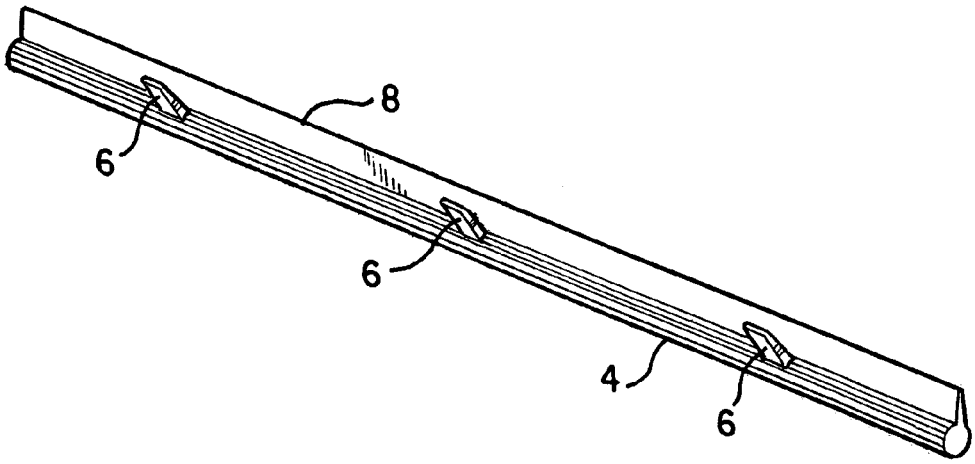
FIG. 13 is a perspective view of a cleaning strip assembly for use in a surface cleaning apparatus according to the invention.

In some embodiments, the sweeper also includes a cleaning strip. The cleaning strip assembly 2 as shown in FIG. 13 comprises an elongate support member 4 comprising a flexible material, for example rubber or a plastic material, with a substantially circular cross-section. Formed integral with the elongate member 4 are a series of spaced apart flexible tabs 6. Also formed integral with the elongate member 4 is a flexible strip 8 positioned along substantially the entire length of the elongate member. The thickness of the flexible strip 8 decreases progressively towards an edge furthest from the elongate member. The flexible strip need not be integral with the elongate support member 4. As an alternative, the support member 4 may be formed with a recessed groove extending in the axial direction and the flexible strip 8 may be formed with a projection of complementary configuration to retain the flexible strip in the groove. The groove and the projection may conveniently be substantially T-shaped.

The flexible strip may have any convenient length, for example in the range from 2.5 to 8 mm. However, a length of substantially 4.5 mm has been found to be particularly suitable.

The flexible tabs 6 and the flexible strip 8 are positioned on the elongate member substantially at an angle relative to each other of approximately 45 degrees. The flexible tabs and flexible strip extend in a generally radial direction from the elongate member, and are directed, in use, towards the lower face of the body of the surface cleaning apparatus.

The elongate member of the cleaning strip assembly is housed within a cavity in the underside of the wall 15 of the surface cleaning apparatus so as to be rotatable about the axis of the elongate member. FIG. 15 depicts an embodiment of a surface cleaning apparatus that incorporates a cleaning strip assembly. The cleaning strip assembly is oriented such that the flexible strip is nearest to the front of the surface cleaning apparatus and the flexible tabs are nearer to the rear of the surface cleaning apparatus. The cavity has an open face through which the flexible strip and the flexible tabs protrude. As shown in FIG. 15, the cavity has a first major wall 28, the rear wall in use, which is substantially upright, and a second major wall. The second major wall 30, the front wall in use, is inclined away from the rear wall at a nominal angle of 60 degrees. The inner face of the cavity, opposite the opening 32, is in the form of a concave curved surface wherein the curvature complements the curvature of the elongate member. The elongate member is retained within the cavity by retaining tabs attached to the rear wall of the cavity at the open face of the cavity. The cavity in the wall 15 is shaped such that excessive rotation of the elongate member in either direction is prevented by the walls of the cavity engaging the flexible tabs or flexible strip.

Lateral movement of the elongate member may be inhibited by any suitable means. For example a cover for part of the drive mechanism may be provided with a protrusion which extends sufficiently to cover the end of the elongate member. Removal of the cover then exposes the end of the elongate member and allows it to be removed, for example for replacement.

Figure 14:
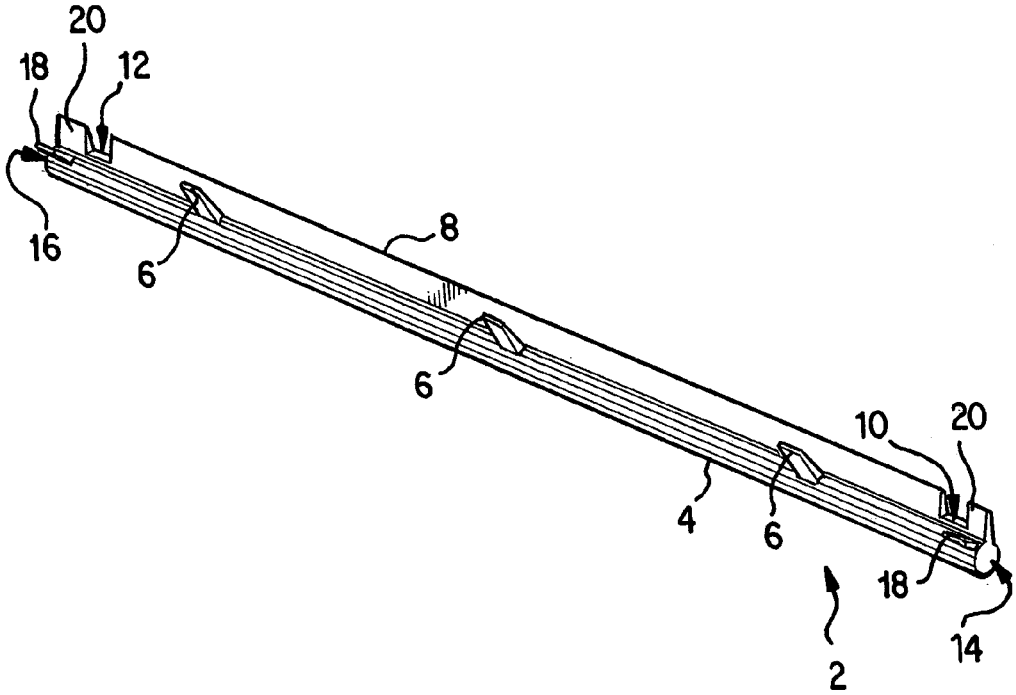
FIG. 14 is a perspective view of another cleaning strip assembly for use in a surface cleaning apparatus according to the invention.

FIG. 14 shows an alternative embodiment of the cleaning strip assembly in which the flexible strip has a first section 10 and a second section 12 positioned close to a first end 14 and to a second end 16, respectively, of the elongate member 4 at which material of the flexible strip is absent such that an isolated portion 20 of the flexible strip is provided at the ends 14, 16 of the elongate member. In use, the isolated portions 20, in conjunction with restraining pins 18 provided on the ends 14, 16 of the elongate member, impinge on retaining tabs of the cavity, such that the ends of the elongate member are prevented from being pulled towards each other during flexure of the elongate member.

Figure 15A:
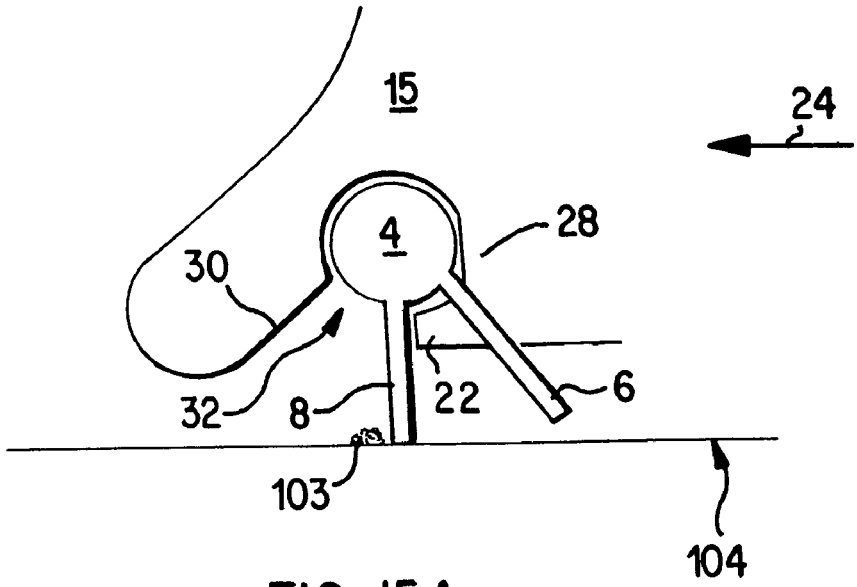
FIG. 15 is a perspective view of the cleaning strip in a first and a second orientation.

The cleaning strip assembly 2 is used to ensure that efficient cleaning of surfaces, for example hard floor surfaces, is achieved. As shown in FIG. 15A, when the surface cleaning apparatus is pushed forward 24 over a surface 104 to be cleaned, the flexible tabs 6 of the cleaning strip respond to movement of the apparatus by being dragged backwards by friction with the floor causing the elongate member 4 to rotate about its axis. Rotation of the elongate member brings the flexible strip 8 into contact with the floor. Continued forward movement of the surface cleaning apparatus results in the flexible strip being held in contact with the surface and particles of dirt 103 on the surface to be cleaned are gathered together and pushed forward along with the movement of the surface cleaning apparatus. Excessive rotation of the elongate member 4, when the surface cleaning apparatus is pushed forwards 24, is prevented by the rear face of the flexible strip engaging on the retaining tabs 22 which retain the elongate member within the cavity 32 of the wall 15. Further rotation is also prevented by the flexible tabs 6 engaging the rear wall 28 of the cavity 32.

Figure 15B:
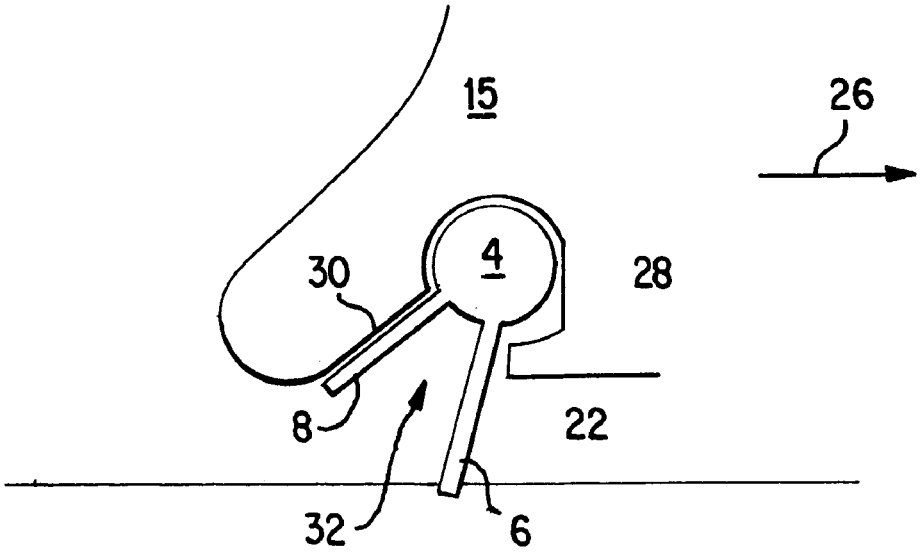

FIG. 15B shows, when the surface cleaning apparatus is moved in a rearward direction 26, the flexible strip 8 responds to movement of the apparatus by being dragged towards the front of the surface cleaning apparatus by friction with the surface 104 to be cleaned. In dragging the flexible strip forwards, the elongate member 4 of the cleaning strip assembly is rotated such that the flexible tabs 6 are brought into contact with the floor 104. The flexible tabs 6 are also dragged towards the front of the surface cleaning apparatus so resulting in continued rotation of the elongate member and the subsequent lifting of the flexible strip clear of the floor. Excessive rotation of the elongate member is prevented by the flexible strip engaging the inclined front wall 30 of the cavity 32 in wall 15 and being stopped from further forward movement. When the surface cleaning apparatus is pulled in a rearward direction, the particles of dirt gathered together by the flexible strip during use in the forward direction are swept from the surface by the brush arrangement and propelled up and over the wall 15 and into the intermediate compartment 17. As the flexible strip is clear of the floor, additional particles of dirt can pass between adjacent flexible tabs and are not prevented from passing under the flexible strip.

The surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations.

When the surface cleaning apparatus is not in use, it can be stored, for example either in a cupboard or the like or plugged into a main supply in order to recharge the battery 7.

Thus the illustrated surface cleaning apparatus incorporating the cleaning strip assembly of the present invention incorporates an electrically driven brush arrangement. The brush arrangement is not driven by frictional forces between the surface cleaning apparatus and the surface over which it is to be moved. Thus, efficiency of the apparatus is not dependent on the nature of the frictional contact. Further, the apparatus does not rely on suction means to draw the debris into a storage chamber. Thus, efficiency of the apparatus is not dependent on the effectiveness of suction means and the substantial power drain of suction means on the rechargeable battery is avoided. The provision of the motor at the rear of the apparatus eliminates the need for increased height should the motor be positioned over the compartment for collecting dust and the like and also provides effective full width cleaning which would not be possible if the motor was to be positioned within the compartment for collecting debris. In such a position, debris is likely to accumulate around the motor and cause blockages. The illustrated apparatus overcomes this problem by passing the drive means for the brush arrangement at least partly through the debris compartment.

Although the cleaning strip assembly described hereinbefore is shown as comprising an elongate member with a substantially circular cross-sectional area having attached thereto at least one tab and a strip member, it should be appreciated that the cleaning strip assembly may take other embodiments and the moving of the strip member relative to a floor may be achieved by other methods rather than by rotation of the elongate body of the cleaning strip assembly.

FIG. 16 shows another embodiment of a cleaning strip assembly 202 which comprises an elongate member 204 of rigid material, for example plastic material, which is attached to a flexible strip 208, for example of a plastic or rubber material, positioned along substantially the entire length of the elongate member 204. The thickness of the flexible strip 208 decreases progressively towards an edge furthest from the elongate member. The thickness of the flexible strip is less than that of the elongate body such that a shoulder portion 210 is formed either side of the flexible strip where it is attached to the elongate member.

The flexible strip is directed, in use, towards the lower face of the body of the surface cleaning apparatus.

The elongate member of the cleaning strip assembly is housed within the cavity (not shown) in the underside of the wall 15 of the surface cleaning apparatus so as to be movable in a substantially upright plane relative to the floor. The cavity also contains an arm 212 fixed at one end to a pivot pin 214 which can rotate about a fixed axis within the cavity. In use, the fixed axis of the pivot pin 214 is substantially parallel to the surface of the floor. The end of the arm 212 furthest from the pivot pin is positioned beneath a shoulder portion 210 of the cleaning strip assembly. Also attached to the pivot pin 214 within the cavity are a number of flexible tabs 206. The free end of each tab 206, in use, is in contact with the floor 104.

The cavity has an open face through which the flexible strip and the flexible tabs protrude. The elongate member 204 is retained within the cavity by means of the arm 212 positioned below the shoulder portion 210 of the cleaning strip assembly.

Figure 16A:
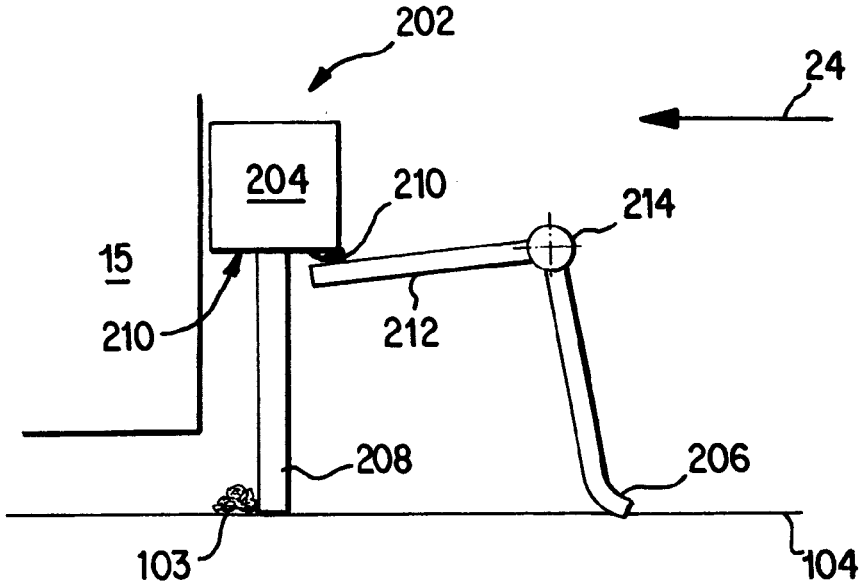
FIG. 16 is a side elevational view of an alternative embodiment of a cleaning strip assembly in a lowered and raised position, showing the relationship between the cleaning strip and a separate friction means.

As shown in FIG. 16A, when the surface cleaning apparatus is pushed forward as shown by the arrow 24 over a surface 104 to be cleaned, the flexible tabs 206 of the cleaning strip assembly are dragged backwards by friction with the floor causing the arm 212 to pivot about the fixed axis of the pivot pin 214 towards the floor. Pivoting of the arm away from the shoulder portion 210 of the cleaning strip assembly allows the elongate member of the cleaning strip assembly to lower and bring the flexible strip 208 into contact with the floor. Particles of dirt 103 on the surface to be cleaned are gathered together by the flexible strip and pushed forward along with the movement of the surface cleaning apparatus.

Figure 16B:
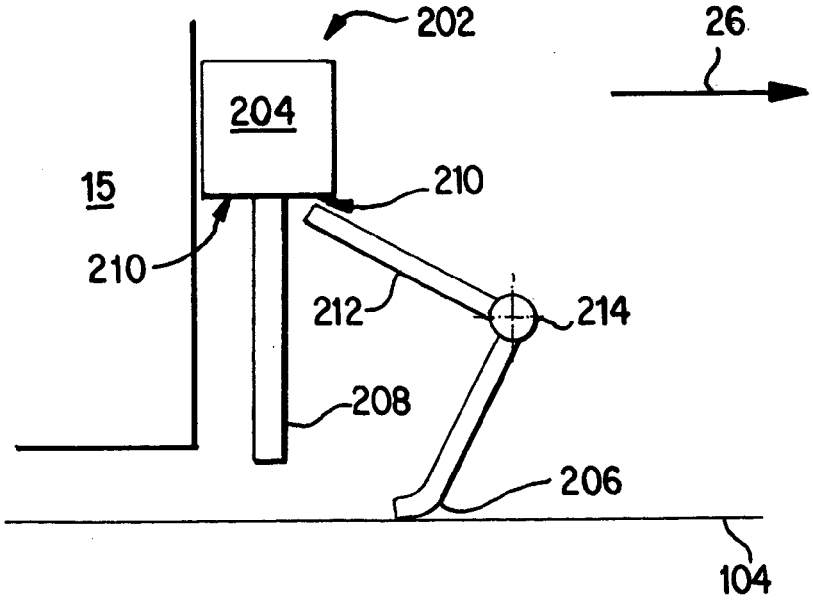

FIG. 16B shows, when the surface cleaning apparatus is moved in a rearward direction as shown by the arrow 26, the flexible tabs are dragged toward the front of the surface cleaning apparatus by friction with the surface 104 to be cleaned. In dragging the flexible tabs forward, the arm 212 pivots away from the floor about the fixed axis of the pivot pin 214. The arm 212, positioned under the shoulder 210 of the cleaning strip assembly, urges the cleaning strip assembly in a substantially upward direction such that the flexible strip 208 is lifted clear of the floor.

When the surface cleaning apparatus is pulled in a rearward direction, the particles of dirt gathered together by the flexible strip during use in the forward direction are swept from the surface by the brush arrangement. As the flexible strip is clear of the floor, additional particles of dirt can pass between adjacent flexible tabs and are not prevented from passing under the flexible strip.

Figure 17:
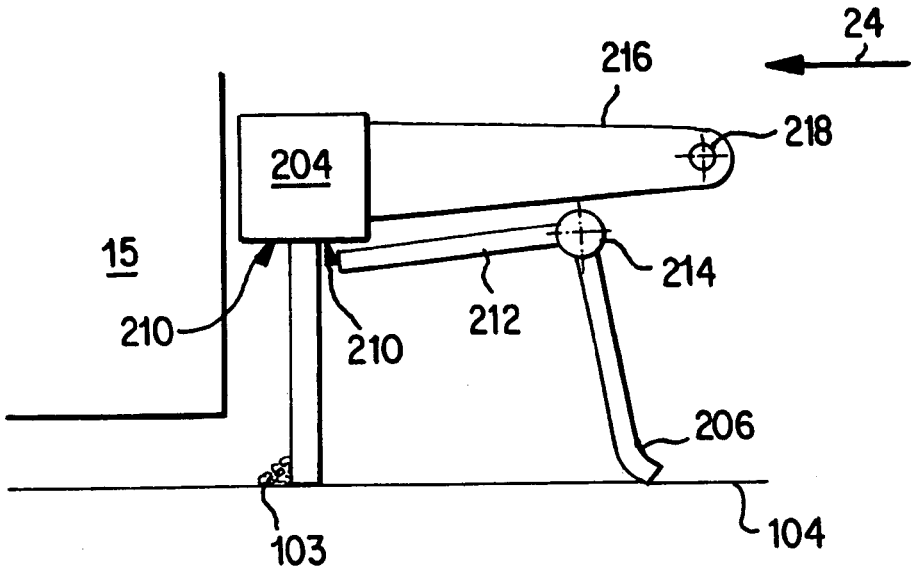
FIG. 17 is side elevational view of a further embodiment of a cleaning strip assembly in a lowered position.

FIG. 17 shows a further embodiment of the cleaning strip assembly, wherein the cleaning strip assembly comprises an elongate member 204 of rigid material, for example plastics material, which is attached to a flexible strip 208 positioned along substantially the entire length of the elongate member. The thickness of the flexible strip 208 decreases progressively towards an edge furthest from the elongate member. The thickness of the flexible strip is less than that of the elongate body such that a shoulder portion 210 is formed either side of the flexible strip where it is attached to the elongate member.

The cavity also contains a first arm 212 fixed at one end to a pivot pin 214 which can rotate about a first fixed axis within the cavity. The end of the first arm 212 furthest from the pivot pin 214 is positioned beneath a shoulder portion 210 of the cleaning strip assembly. Also attached to the pivot pin within the cavity are a number of flexible tabs 206. The free end of each tab 206, in use, is in contact with the floor 104.

Attached to the elongate body 204 is a second arm 216 which connects the cleaning strip assembly 202 to a second pivot pin 218 within the cavity in the wall of the surface cleaning apparatus. The elongate member of the cleaning strip assembly is housed within the cavity of the surface cleaning apparatus so as, when in use, to be pivotably moved on the second arm 216 relative to the floor about an axis of the second pivot pin 218 substantially parallel with the surface of the floor.

The cavity comprises an open face through which the flexible strip and the flexible tabs protrude. The elongate member is retained within the cavity by means of the first arm 212 positioned below the shoulder portion 210 of the cleaning strip assembly and by means of the second arm 216 attaching the cleaning strip assembly to the second pivot pin 218.

When the surface cleaning apparatus is pushed forward 24 over a surface 104 to be cleaned, the flexible tabs 206 of the cleaning strip assembly are dragged backwards by friction with the floor causing the first arm 212 to pivot towards the floor about the axis of the first pivot pin 214. Pivoting of the first arm 212 allows the elongate member of the cleaning strip assembly to pivot on the second arm 216 about the axis of the second pivot pin 218 and so bring the flexible strip 208 into contact with the floor. As described hereinabove, particles of dirt 103 on the surface to be cleaned are gathered together by the flexible strip and pushed forward along with the movement of the surface cleaning apparatus.

When the surface cleaning apparatus is moved in a rearward direction the flexible tabs are dragged towards the front of the surface cleaning apparatus by friction with the surface 104 to be cleaned. In dragging the flexible tabs forward, the first arm 212 pivots away from the floor about the axis of the first pivot pin 214. The first arm, positioned under the shoulder 210 of the cleaning strip assembly, urges the cleaning strip assembly in a substantially upward direction such that the flexible strip is lifted clear of the floor and pivots, via the second arm 213, about the axis of the second pivot pin 218.

When the surface cleaning apparatus is pulled in a rearward direction, the particles of dirt gathered together by the flexible strip during use in the forward direction are swept from the surface by the brush arrangement. As the flexible strip is clear of the floor, additional particles of dirt can pass between adjacent flexible tabs and are not prevented from passing under the flexible strip.

Figure 18:
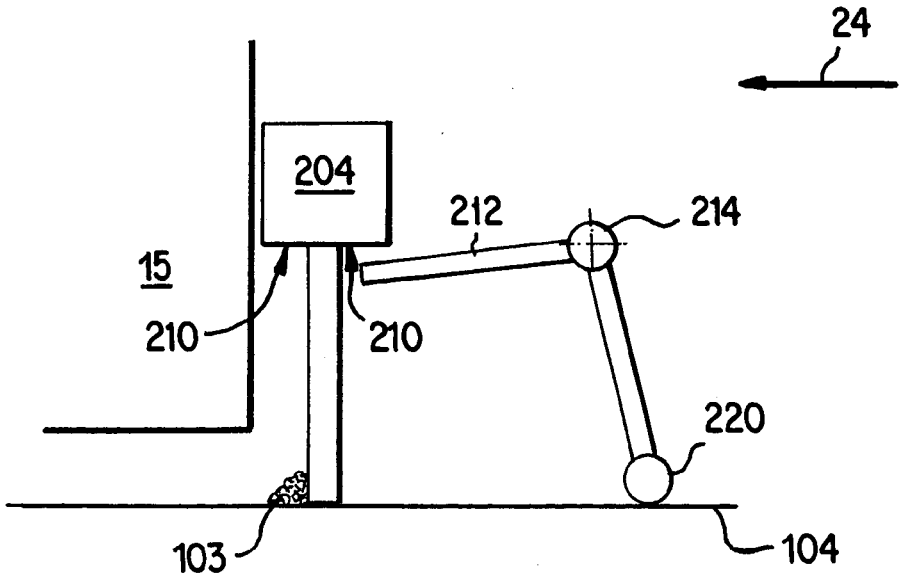
FIG. 18 is a side elevational view of the cleaning strip assembly of FIG. 16 showing an alternative form of friction means.

It should be understood that an alternative to the flexible tabs described hereinabove could be a friction wheel 220, as shown in FIG. 18, whereby movement of the friction wheel 220 relative to the floor can be used to cause an arm 212 beneath the shoulder portion 210 of the cleaning strip assembly to be moved thus raising and lowering the cleaning strip assembly as described hereinabove.

It should be understood that electronic or other means may be used in place of frictional means to determine the movement of the surface cleaning apparatus and for controlling the positioning of the flexible strip.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A surface cleaning apparatus, comprising:

a) a body having a forward compartment and rear compartment;

b) an elongate rotatable brush extending across the forward compartment;

c) an electric motor for driving the rotatable brush ; and d) a handle movable between an upright position and steering positions by rotation about an axis transverse to the axial direction of the handle, said handle being further rotatable around a second axis in said steering positions said second axis of rotation being offset from the axial direction of the handle, wherein the body further comprises a collar that prevents rotation of the handle around said second axis in the upright position.

2. The apparatus of claim 1, further comprising an auxiliary brush extending from the forward compartment and driven by the motor.

3. The apparatus of claim 2, wherein the elongate rotatable brush and auxiliary brush are driven by the electric motor.

4. The apparatus of claim 3, wherein the auxiliary brush and the elongate rotatable brush are connected by a gear.

5. The apparatus of claim 1, further comprising an intermediate compartment defined by a wall between the forward compartment and the intermediate compartment, a wall between the intermediate compartment and the rear compartment, and side walls.

6. The apparatus of claim 5, wherein one side wall is removable to facilitate removal of debris.

7. The apparatus of claim 6, wherein the removable side wall includes a cover.

8. The apparatus of claim 5, wherein the intermediate compartment includes a tray that can be removed and emptied so as to discharge debris.

9. The apparatus of claim 5, wherein the intermediate compartment is a removable tray having at least one wall that forms a wall of said body.

10. The apparatus of claim 5, wherein the belt is enclosed within a tunnel that passes through the intermediate compartment.

11. The apparatus of claim 10, wherein one side wall is removable to facilitate removal of debris and the tunnel is arranged at a side remote from the removable side wall.

12. The apparatus of claim 5, wherein the wall between the forward and intermediate compartments is inclined rearwardly.

13. The apparatus of claim 12, wherein the wall between the forward and intermediate compartments has an angle of inclination of from 15 to 20 degrees.

14. The apparatus of claim 5, wherein the wall between the intermediate and rear compartments seals the rear compartment from the intermediate compartment.

15. The apparatus of claim 1, wherein a front part of the forward compartment is movable to expose bristles on the elongate rotatable brush at the front part of the forward compartment.

16. The apparatus of claim 1, wherein the rear compartment is provided with ground-engaging wheels.

17. The apparatus of claim 1, further comprising a cleaning strip assembly pivotably mounted on an underside of the body.

18. The apparatus of claim 17, wherein the cleaning strip assembly comprises an elongate support member and a flexible strip extending radially from the support member.

19. The apparatus of claim 18, wherein the elongate support member extends along substantially the entire length of the body.

20. The apparatus of claim 17, wherein the cleaning strip assembly further comprises at least one tab oriented to contact the surface being cleaned during cleaning.

21. The apparatus of claim 20, wherein the at least one tab is oriented so that contact of the at least one tab with the surface being cleaned is capable of causing the cleaning strip assembly to pivot between a cleaning position and an elevated position.

22. The apparatus of claim 1, wherein the forward compartment further comprises an opening in a lower surface thereof, and wherein a lower front region of the body is chamfered so that bristles of the elongate brush protrude from the body in the region of the chamfer such that, when the apparatus is inclined relative to a surface to be cleaned, contact between the bristles and the surface to be cleaned is increased.

23. A surface cleaning apparatus, comprising:

a) a body having a forward compartment and rear compartment;

b) an elongate rotatable brush extending across the forward compartment;

c) an electric motor for driving the rotatable brush;

d) an intermediate compartment comprising a removable tray, wherein at least one side of the removable tray forms a wall of said body; and e) a handle movable between an upright position and steering positions by rotation about an axis transverse to the axial direction of the handle, said handle being further rotatable around a second axis in said steering positions said second axis of rotation being offset from the axial direction of the handle, and the body further comprises a collar that prevents rotation of the handle about the axis offset from the axial direction of the handle in an upright position.

24. The apparatus of claim 23, further comprising an auxiliary brush extending from the forward compartment and driven by the electric motor.

25. The apparatus of claim 24, wherein the auxiliary brush and the elongate rotatable brush are connected by a gear.

26. The apparatus of claim 25, wherein one side wall is removable to facilitate removal of debris.

27. The apparatus of claim 23, wherein the removable tray includes a cover.

28. The apparatus of claim 23, wherein the belt is enclosed within a tunnel that passes through the intermediate compartment.

29. The apparatus of claim 28, wherein the tunnel is arranged at a side remote from said side of the removable tray that forms a wall of said body.

30. The apparatus of claim 23, wherein the wall between the forward and intermediate compartments is inclined rearwardly.

31. The apparatus of claim 30, wherein the wall between the forward and intermediate compartments has an angle of inclination of from 15 to 20 degrees.

32. The apparatus of claim 23, wherein the wall between the intermediate and rear compartments seals the rear compartment from the intermediate compartment.

33. The apparatus of claim 23, wherein a front part of the forward compartment is movable to expose bristles on the elongate rotatable brush at the front part of the forward compartment.

34. The apparatus of claim 23, wherein the rear compartment is provided with ground-engaging wheels.

35. The apparatus of claim 23, wherein the forward compartment further comprises an opening in a lower surface thereof, and wherein a lower front region of the body is chamfered so that bristles of the elongate brush protrude from the body in the region of the chamfer such that, when the apparatus is inclined relative to a surface to be cleaned, contact between the bristles and the surface to be cleaned is increased.

* * * * *